US010604370B2

(12) United States Patent
Yamamoto et al.

(10) Patent No.: US 10,604,370 B2
(45) Date of Patent: Mar. 31, 2020

(54) SHEET CONVEYING APPARATUS AND IMAGE FORMING APPARATUS

(71) Applicant: CANON KABUSHIKI KAISHA, Tokyo (JP)

(72) Inventors: Daisuke Yamamoto, Kawasaki (JP); Hiroshi Imanari, Yokohama (JP); Ryo Iwasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,672

(22) Filed: Jun. 12, 2018

(65) Prior Publication Data

US 2018/0362283 A1 Dec. 20, 2018

(30) Foreign Application Priority Data

Jun. 19, 2017 (JP) ..... 2017-119843
Jun. 19, 2017 (JP) ..... 2017-119844
Jun. 29, 2017 (JP) ..... 2017-127998

(51) Int. Cl.
*B65H 29/60* (2006.01)
*B65H 5/36* (2006.01)
(Continued)

(52) U.S. Cl.
CPC ..... *B65H 29/60* (2013.01); *B65H 5/062* (2013.01); *B65H 5/36* (2013.01); *B65H 29/58* (2013.01);
(Continued)

(58) Field of Classification Search
CPC ..... B65H 29/58; B65H 29/60; B65H 85/00; B65H 2301/333; B65H 2301/3331;
(Continued)

(56) References Cited

U.S. PATENT DOCUMENTS 8,276,913 B2 * 10/2012 Bianco ..... B65H 5/26 271/184
8,964,271 B2 * 2/2015 Kaneko ..... G06K 15/16 358/498
8,989,651 B2 * 3/2015 Mori ..... G03G 15/6573 399/401

FOREIGN PATENT DOCUMENTS

JP 2001335216 A 12/2001
JP 2003182907 A 7/2003
(Continued)

*Primary Examiner* — Jeremy R Severson
(74) *Attorney, Agent, or Firm* — Canon U.S.A., Inc. IP Division

(57) ABSTRACT

A sheet conveying apparatus includes a storage portion to store a sheet, first and second stack portions, first and second conveyance paths to convey a sheet towards the first stack portion and the second stack portion, respectively, a first conveyance unit, a reverse path, and a second conveyance unit. The first conveyance unit is provided downstream of the first conveyance path and reverses and conveys a sheet conveyed to the first conveyance path. The reverse path conveys, once more to the first conveyance path, a sheet that has been reversed by the first conveyance unit. The second conveyance unit is provided in the second conveyance path and downstream of an intersection point between the second conveyance path and the reverse path. While conveying and reversing a sheet conveyed to the second conveyance path towards the reverse path, the second conveyance conveys the conveyed sheet towards the second stack portion.

14 Claims, 23 Drawing Sheets

(51) Int. Cl.

| | |
|---|---|
| ***B65H 31/24*** | (2006.01) |
| ***B65H 5/06*** | (2006.01) |
| ***B65H 85/00*** | (2006.01) |
| ***B65H 29/58*** | (2006.01) |

(52) U.S. Cl.
CPC ..... *B65H 31/24* (2013.01); *B65H 85/00* (2013.01); *B65H 2301/33312* (2013.01); *B65H 2402/10* (2013.01); *B65H 2402/45* (2013.01); *B65H 2404/513* (2013.01); *B65H 2404/632* (2013.01); *B65H 2601/11* (2013.01); *B65H 2801/06* (2013.01)

(58) Field of Classification Search
CPC .. B65H 2301/33312; B65H 2301/3332; B65H 31/24; G03G 2215/00586
See application file for complete search history.

(56) References Cited

FOREIGN PATENT DOCUMENTS

| | | | |
|---|---|---|---|
| JP | 2004099293 | A | 4/2004 |
| JP | 2004217336 | A | 8/2004 |
| JP | 200791358 | A | 4/2007 |
| JP | 2008285279 | A | 11/2008 |
| JP | 200919832 | A | 1/2009 |
| JP | 201211564 | A | 1/2012 |
| JP | 201363844 | A | 4/2013 |
| JP | 2014206607 | A | 10/2014 |

* cited by examiner

SHEET CONVEYING APPARATUS AND IMAGE FORMING APPARATUS

BACKGROUND OF THE INVENTION

Field of the Invention

The present disclosure relates to a sheet conveying apparatus that conveys sheets in a continuous manner and to an image forming apparatus, such as a copier, a printer, or a facsimile, that includes the sheet conveying apparatus.

Description of the Related Art

In recent years, double-side printing is used a great deal in image forming apparatuses. Furthermore, configurations of image forming apparatuses improving sheet conveying performance by providing a plurality of conveyance paths that convey sheets and a plurality of stack portions on which sheets discharged from the image forming apparatus are stacked. Japanese Patent Laid-Open No. 2007-91358 discloses a configuration of an image forming apparatus including a switchback-type reversing portion provided to perform double-side printing, and a plurality of discharge trays serving as stack portions. In the configuration in Japanese Patent Laid-Open No. 2007-91358, a sheet can be discharged to the first discharge tray from the reversing portion, and double-side printing can be performed by reversing the conveyed sheet at the reversing portion and by conveying the sheet to an image forming portion once again.

However, in the configuration in Japanese Patent Laid-Open No. 2007-91358, since the reverse path that conveys the sheet reversed at the reversing portion and the conveyance path that conveys the sheet to the second discharge tray from the image forming portion intersect each other, the following issue may occur. That is, since it is difficult to discharge a sheet towards the second discharge tray while a sheet is reversed in the reversing portion, the sheet conveying performance may decrease.

SUMMARY OF THE INVENTION

According to an aspect of the present invention, a sheet conveying apparatus includes a storage portion configured to store a sheet, a first stack portion on which a sheet is to be stacked, a first conveyance path through which a sheet is conveyed from the storage portion towards the first stack portion, a first conveyance unit provided downstream of the first conveyance path in a direction in which a sheet is conveyed from the storage portion towards the first stack portion, wherein the first conveyance unit is configured to reverse and convey a sheet that has been conveyed to the first conveyance path, a reverse path configured to convey, once more to the first conveyance path, a sheet that has been reversed by the first conveyance unit, a second stack portion on which a sheet is to be stacked, wherein the second stack portion is provided at a position different from that of the first stack portion, a second conveyance path that branches from the first conveyance path and is configured to convey a sheet towards the second stack portion, and a second conveyance unit that is provided in the second conveyance path and downstream of an intersection point between the second conveyance path and the reverse path in a conveyance direction of a sheet conveyed from the storage portion towards the second stack portion, wherein, while conveying and reversing a conveyed sheet conveyed to the second conveyance path towards the reverse path, the second conveyance conveys the conveyed sheet towards the second stack portion.

In a configuration in which a conveyance path and a reverse path intersect each other, reversing of a sheet is performed with a second discharge sheet reversing portion. The second discharge sheet reversing portion is, with respect to an intersection point at which the conveyance path and the reverse path intersect each other, provided downstream in a conveyance direction of the sheet conveyed towards a sheet discharge tray. The second discharge sheet reversing portion conveys a sheet towards the sheet discharge tray while reversing a sheet conveyed to the conveyance path. Further features of the present invention will become apparent from the following description of embodiments with reference to the attached drawings.

DESCRIPTION OF THE EMBODIMENTS

Figure 1:
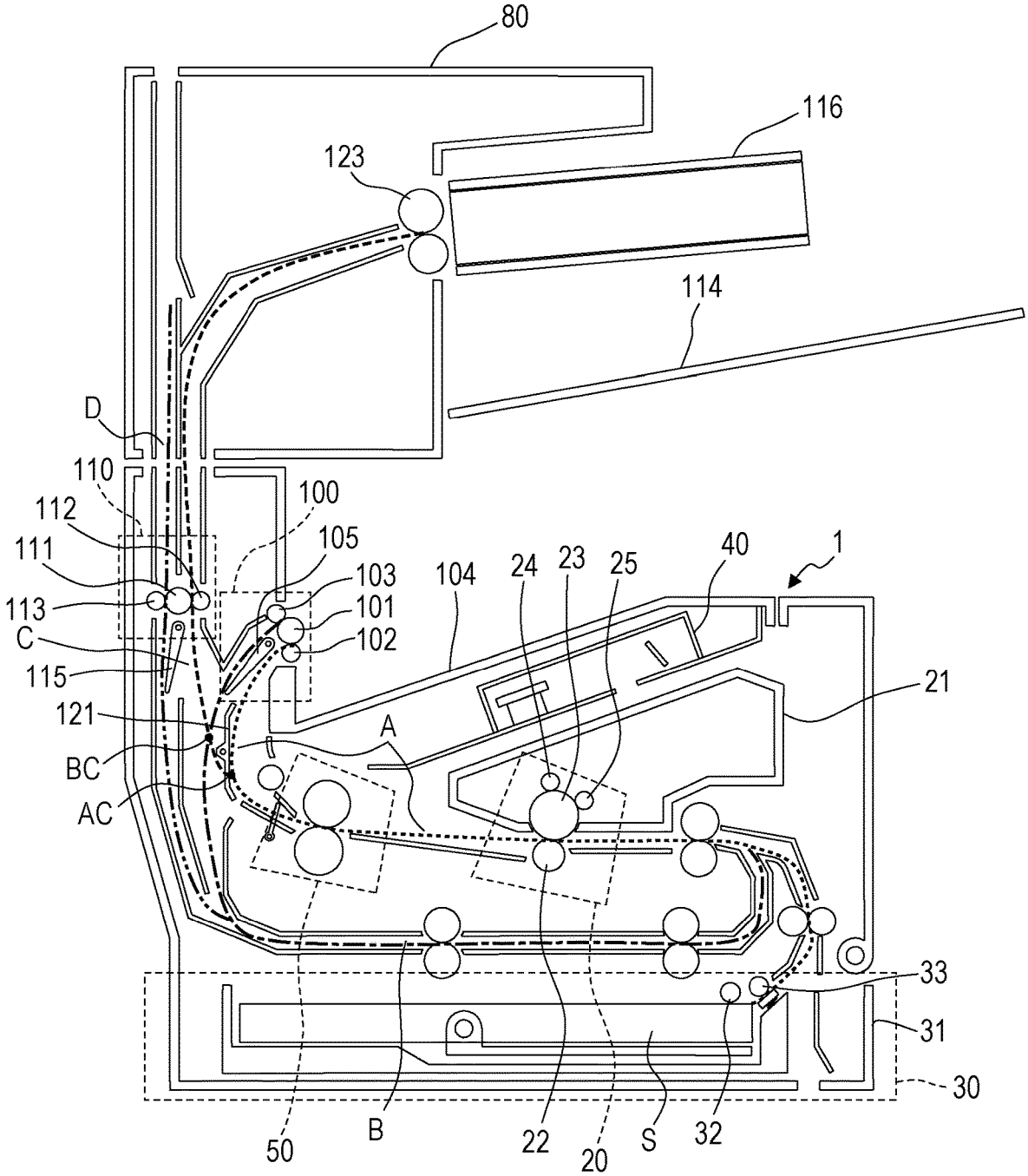
FIG. 1 is a schematic cross-sectional view illustrating a configuration of an image forming apparatus of a first embodiment.

Hereinafter, referring to the drawings, embodiments of the present disclosure will be exemplified in detail. Note that described in the embodiments below are examples in which a laser beam printer including a sheet conveying apparatus of the present disclosure is used. Note that the components described in the embodiments below are for exemplification only and the above components are not to limit the scope of the present disclosure.

First Embodiment

Configuration of Image Forming Apparatus

FIG. 1 is a schematic cross-sectional view illustrating a configuration of an image forming apparatus 1 provided with a sheet conveying apparatus of the present embodiment. As illustrated in FIG. 1, the image forming apparatus 1 includes an image forming portion 20, a feeding portion 30, a laser scanner unit 40, a fixing portion 50, a first discharge sheet reversing portion 100 (a first conveyance unit), a second discharge sheet reversing portion 110 (a second conveyance unit), and a flapper 121 (a first guiding member).

A sheet feeding cassette 31 serving as a storage portion is detachably provided upstream of the image forming portion 20 in a sheet conveyance direction and feeds sheets S stored therein in a stacked state towards the image forming portion 20 with a feed roller 32 and a separation roller 33. A sheet discharge tray 104 serving as a first stack portion on which a sheet S, on which formation of image has been completed, is discharged from the image forming apparatus 1 is provided downstream of the first discharge sheet reversing portion 100 in the sheet conveyance direction.

The image forming portion 20 includes a process cartridge 21 that is detachable from a main body of the image forming apparatus 1, and a transfer roller 22. The process cartridge 21 includes a photosensitive drum 23 serving as an image bearing member, a charge roller 24, and a development roller 25. An electrostatic latent image is formed on a surface of the photosensitive drum 23 by emitting, on the photosensitive drum 23 that has been uniformly charged by the charge roller 24, a beam from the laser scanner unit 40 based on image information. A toner image is formed on the surface of the photosensitive drum 23 by developing the electrostatic latent image with toner carried on the development roller 25. The developed toner image is, with the transfer roller 22, transferred on a sheet S that is fed from the sheet feeding cassette 31 and that is conveyed towards a conveyance path A (a first conveyance path) and is fixed on the sheet S by being heated and compressed in the fixing portion 50. Subsequently, the sheet S is conveyed through the conveyance path A towards the first discharge sheet reversing portion 100 and is discharged onto the sheet discharge tray 104.

Note that an image reading portion 80, a sheet processing unit 116 including an aligning mechanism that aligns the sheets S and a staple mechanism, and a sheet discharge tray 114 serving as a second stack portion on which the sheets S are stacked are provided on an upper portion of the image forming apparatus 1 of the present embodiment. By conveying the sheet S through the conveyance path A towards the second discharge sheet reversing portion 110, the sheet S can be conveyed to a conveyance path C (a second conveyance path) and the sheet S can be discharged to the sheet processing unit 116 through a discharge roller 123 or the sheet S can be discharged to the sheet discharge tray 114. The conveyance path C is branched from the conveyance path A, and the flapper 121 is provided at a branching point AC between the conveyance path A and the conveyance path C.

The first discharge sheet reversing portion 100 includes a driving roller 101 (a first rotating member), a sheet discharge roller 102 (a second rotating member), a reverse roller 103 (a third rotating member), and a flapper 105 (a second guiding member). Receiving driving force from a drive source (not shown), the driving roller 101 is rotated, and following the rotation of the driving roller 101, the sheet discharge roller 102 and the reverse roller 103 are rotated. Furthermore, the sheet discharge roller 102 is in contact with the driving roller 101, and the reverse roller 103 is in contact with the driving roller 101 at a position that is different from that of the sheet discharge roller 102 in a circumferential direction of the driving roller 101.

The second discharge sheet reversing portion 110 includes a driving roller 111 (a fourth rotating member), a sheet discharge roller 112 (a fifth rotating member), a reverse roller 113 (a sixth rotating member), and a flapper 115 (a third guiding member). Receiving driving force from a drive source (not shown), the driving roller 111 is rotated, and following the rotation of the driving roller 111, the sheet discharge roller 112 and the reverse roller 113 are rotated. Furthermore, the sheet discharge roller 112 is in contact with the driving roller 111, and the reverse roller 113 is in contact with the driving roller 111 at a position that is different from that of the sheet discharge roller 112 in a circumferential direction of the driving roller 111.

Conveyance of the sheet S according to the present embodiment will be described next with reference to FIGS. 2A to 2D, and FIGS. 3A to 3D. FIGS. 2A to 2D are schematic diagrams illustrating the conveyance of the sheet S in the first discharge sheet reversing portion 100, and FIGS. 3A to 3D are schematic diagrams illustrating the conveyance of the sheet S in the second discharge sheet reversing portion 110.

Conveyance of Sheet S in First Discharge Sheet Reversing Portion 100

Figure 2A:
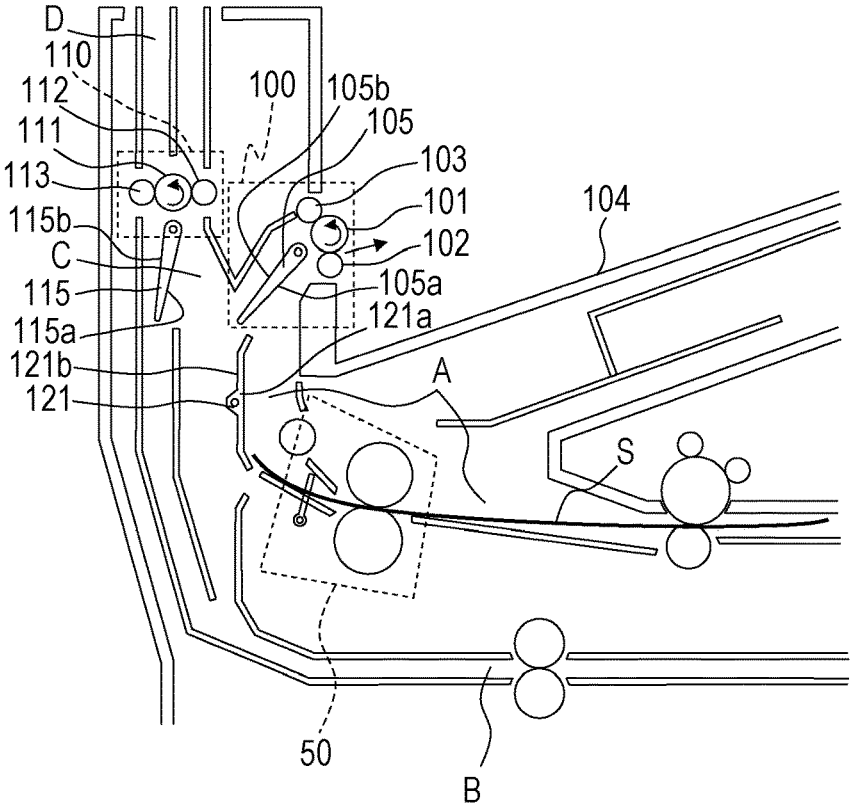
FIGS. 2A to 2D are schematic diagrams illustrating conveyance of a sheet in a first discharge sheet reversing portion of the first embodiment.
Figure 2B:
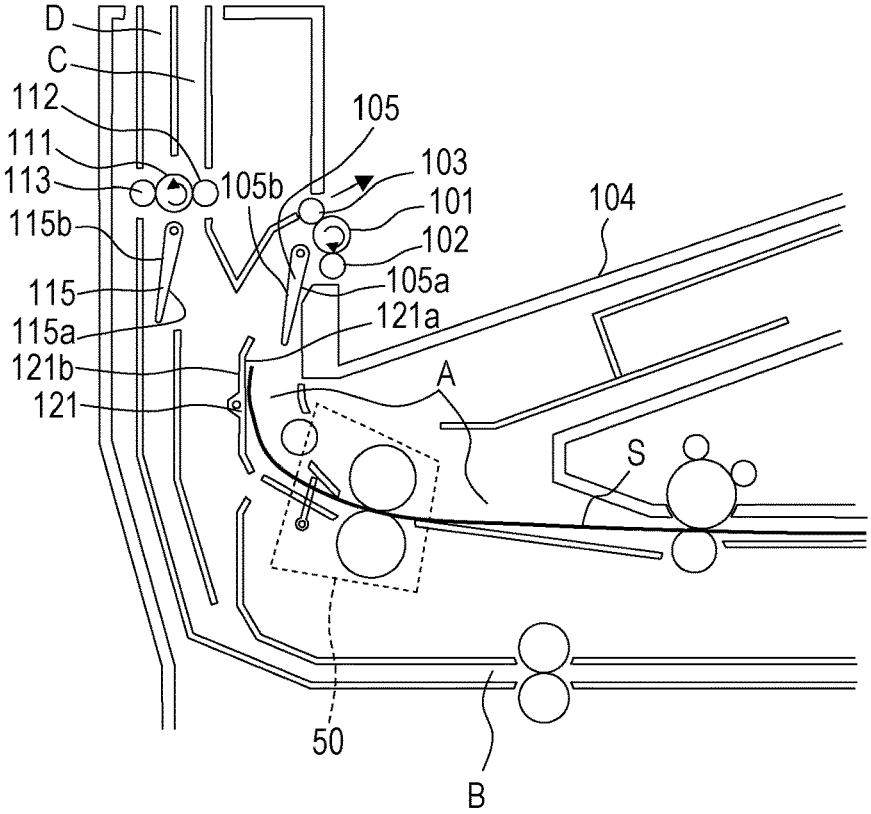

As illustrated in FIGS. 2A and 2B, stand-by positions of the flapper 105 are switched by synchronizing with the rotation of the driving roller 101. During normal times, the driving roller 101 rotates in a direction (counterclockwise) that allows the sheet S to be discharged to the sheet discharge tray 104 through where the driving roller 101 and the sheet discharge roller 102 abut against each other. In the above times, the flapper 105 is held at a first position illustrated in FIG. 2A.

As illustrated in FIG. 2A, when the sheet S is discharged to the sheet discharge tray 104, the sheet S is guided towards the flapper 105 provided downstream of the flapper 121 with a guide surface 121*a* (a first guide surface) of the flapper 121. Subsequently, the sheet S is guided to a guide surface 105*a* (a third guide surface) of the flapper 105 and is discharged onto the sheet discharge tray 104 through where the driving roller 101 and the sheet discharge roller 102 abut against each other.

As illustrated in FIG. 2B, when images are formed on both surfaces of the sheet S and the sheet S is discharged onto the sheet discharge tray 104, a rotation direction of the driving roller 101 is switched to a clockwise direction from a counterclockwise direction while a front edge of the sheet S is conveyed along the guide surface 121*a* of the flapper 121. In so doing, the flapper 105 moves to a second position illustrated in FIG. 2B together with the switching of the rotation direction of the driving roller 101. Furthermore, the sheet S is guided to a guide surface 105*b* (a fourth guide surface) of the flapper 105 and is conveyed in a direction illustrated by a solid line arrow and through where the driving roller 101 and the reverse roller 103 abut against each other.

Figure 2C:
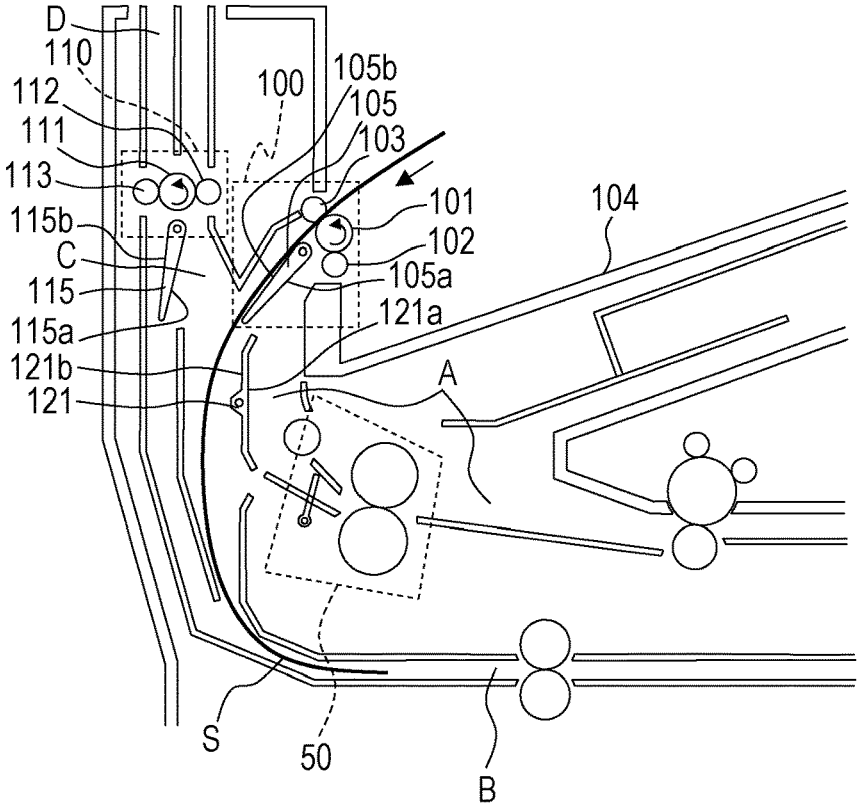

Subsequently, at a timing at which the rear edge of the sheet S in a conveyance direction of the sheet S in the conveyance path A passes an edge of the flapper 121 on the downstream side, the rotation direction of the driving roller 101 is returned to the counterclockwise direction once more and the flapper 105 is moved to the first position. With the above, as illustrated in FIG. 2C, the sheet S is guided to the guide surface 105*b* of the flapper 105 and is conveyed towards a reverse path B through where the driving roller 101 and the reverse roller 103 abut against each other. Furthermore, in so doing, the sheet S conveyed towards the reverse path B is guided to a guide surface 121*b* (a second guide surface) that is a surface opposite to the guide surface 121*a* of the flapper 121. Furthermore, after the above and after being conveyed through the reverse path B to the image forming portion 20 once more, as illustrated in FIG. 2A, the sheet S is discharged onto the sheet discharge tray 104 through where the driving roller 101 and the sheet discharge roller 102 abut against each other.

Figure 2D:
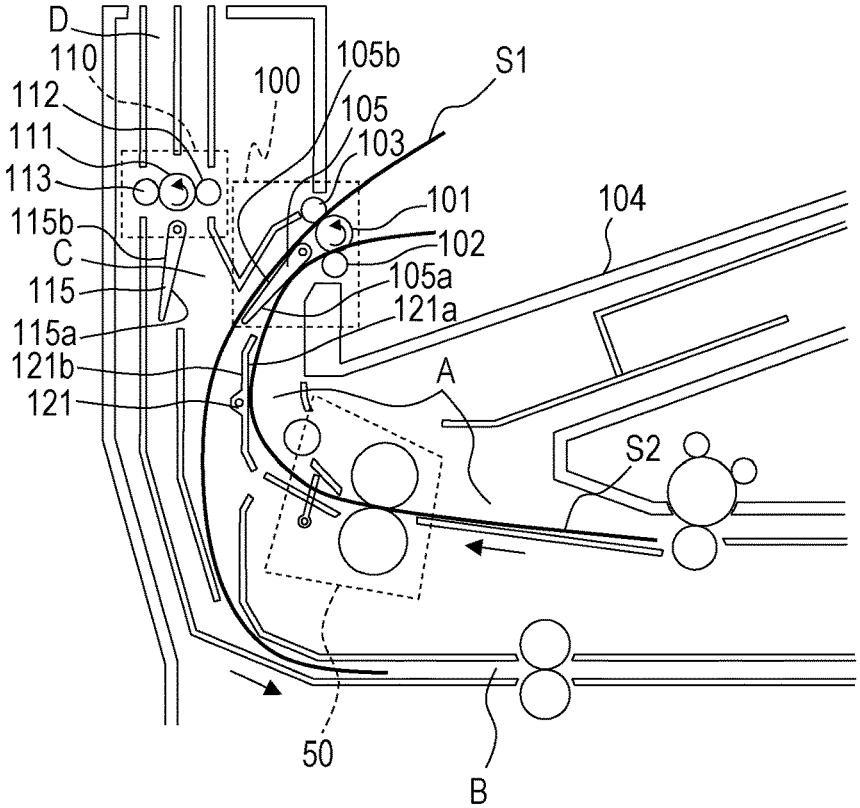

Note that as illustrated in FIG. 2D, in the configuration of the first discharge sheet reversing portion 100 of the present embodiment, while a first sheet S1 that is a preceding sheet is conveyed and reversed towards the reverse path B, a second sheet S2 that is a sheet succeeding the first sheet S1 can be discharged towards the sheet discharge tray 104. As described above, by having two continuously fed sheets be conveyed so as to pass by each other, performance of conveying the sheet S can be refined.

In the present embodiment, a description of the first discharge sheet reversing portion 100 including three series of rollers, namely, the reverse roller 103, the driving roller 101, and the sheet discharge roller 102 has been given; however, the first discharge sheet reversing portion 100 is not limited to such a configuration. A configuration may be used in which a pair of rollers constituted by a driving roller and a driven roller is used and in which the reversing and the discharging of the sheet S is performed by switching the rotation direction of the driving roller. Furthermore, two pairs of rollers, each pair constituted by a driving roller and a driven roller, may perform the reversing of the sheet S and the discharging of the sheet S, and a flapper serving as a second guiding member may be provided between the two pairs of rollers to guide the conveyed sheets S. In a case in which revising and discharging of the sheet S is performed using a single pair of rollers, it will be difficult to convey two continuously fed sheets S to be conveyed to pass by each other, as is the case of the first discharge sheet reversing portion 100 of the present embodiment. However, in the configuration in which two pairs of rollers perform the reversing of the sheet S and the discharge of the sheet S, an effect similar to that of the first discharge sheet reversing portion 100 of the present embodiment can be obtained.

Conveyance of Sheet S in Second Discharge Sheet Reversing Portion 110

Figure 3A:
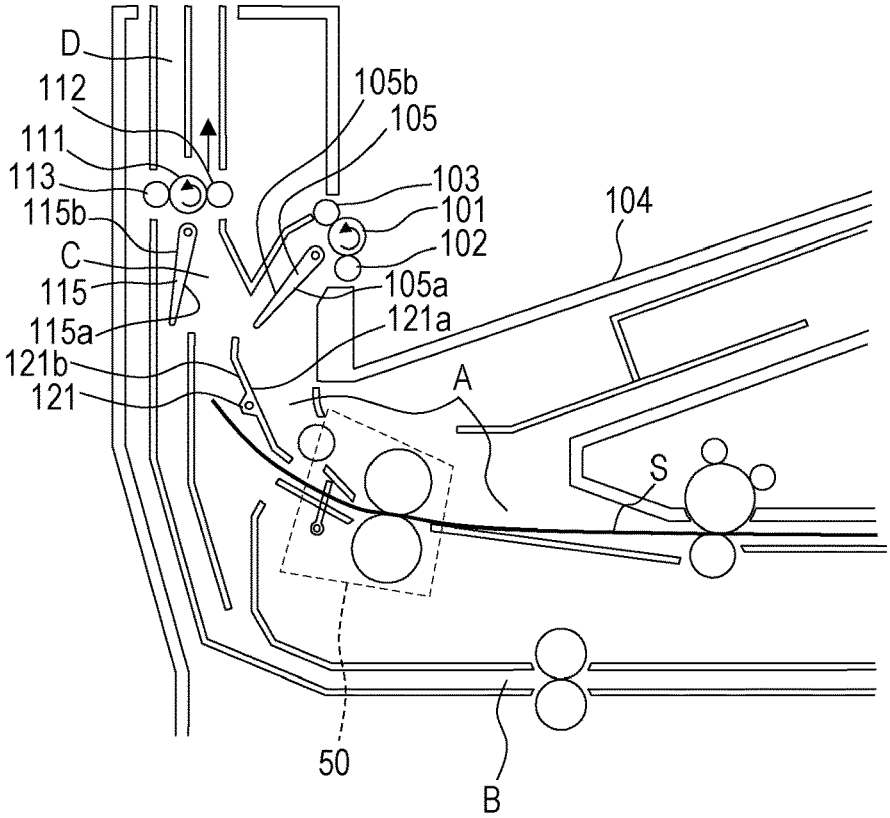
FIGS. 3A to 3D are schematic diagrams illustrating conveyance of a sheet in a second discharge sheet reversing portion of the first embodiment.
Figure 3B:
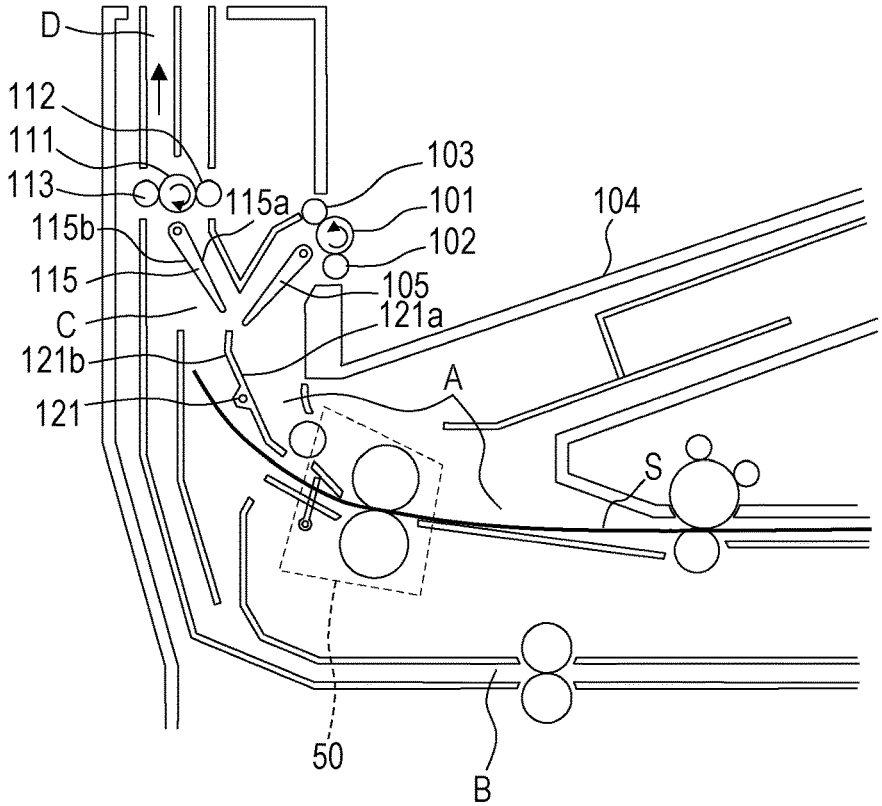

As illustrated in FIGS. 3A and 3B, the stand-by positions of the flapper 115 are switched by synchronizing to the rotation of the driving roller 111. During normal times, the driving roller 111 rotates in a direction (counterclockwise) that allows the sheet S to be discharged to the sheet discharge tray 114 through where the driving roller 111 and the sheet discharge roller 112 abut against each other. In the above times, the flapper 115 is held at a third position illustrated in FIG. 3A.

When the sheet S is conveyed towards the second discharge sheet reversing portion 110, first, the flapper 121 is pivoted from a first state illustrated in FIG. 2A to a second sate illustrated in FIG. 3A. With the above, the sheet S conveyed from the fixing portion 50 is guided by the guide surface 121*b* of the flapper 121 and is conveyed towards the second discharge sheet reversing portion 110. The configuration that pivots the flapper 121 will be described in detail later.

When discharging the sheet S to the sheet discharge tray 114, as illustrated in FIG. 3A, the sheet S conveyed towards the second discharge sheet reversing portion 110 is guided by a guide surface 115*a* (a fifth guide surface) of the flapper 115. Furthermore, after the above and after the sheet S is conveyed in a direction illustrated by a solid line arrow from where the driving roller 111 and the sheet discharge roller 112 abut against each other, the sheet S is discharged onto the sheet discharge tray 114.

In the present embodiment, reversing of the sheet S can be performed not only with the first discharge sheet reversing portion 100, but also with the second discharge sheet reversing portion 110. As illustrated in FIG. 3B, when the sheet S is reversed with the second discharge sheet reversing portion 110, the rotation direction of the driving roller 111 is switched to the clockwise direction from the counterclockwise direction while the front edge of the sheet S is conveyed along the guide surface 121*a* of the flapper 121. In so doing, the flapper 115 moves to a fourth position illustrated in FIG. 3B together with the switching of the rotation direction of the driving roller 111. Furthermore, the sheet S is guided to a guide surface 115*b* (a sixth guide surface) of the flapper 115 and is conveyed in a direction illustrated by a solid line and through where the driving roller 111 and the reverse roller 113 abut against each other.

Figure 3C:
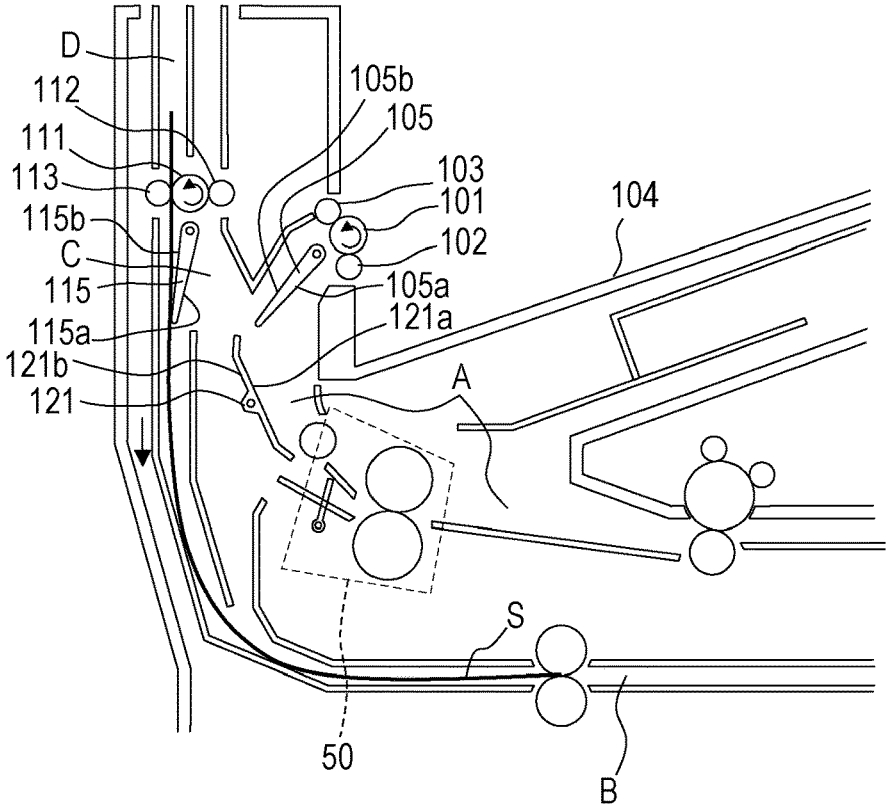

Subsequently, at a timing at which the rear edge of the sheet S in a conveyance direction of the sheet S in the conveyance path C passes an edge of the flapper 121 on the downstream side, the rotation direction of the driving roller 111 is returned to the counterclockwise direction once more and the flapper 115 is moved to the third position. With the above, as illustrated in FIG. 3C, the sheet S is guided to the guide surface 115*b* of the flapper 115 and is conveyed towards the reverse path B through where the driving roller 111 and the reverse roller 113 abut against each other. Furthermore, after the above and after being conveyed through the reverse path B to the image forming portion 20 once more, as illustrated in FIG. 3A, the sheet S is discharged onto the sheet discharge tray 114 through where the driving roller 111 and the sheet discharge roller 112 abut against each other.

Figure 3D:
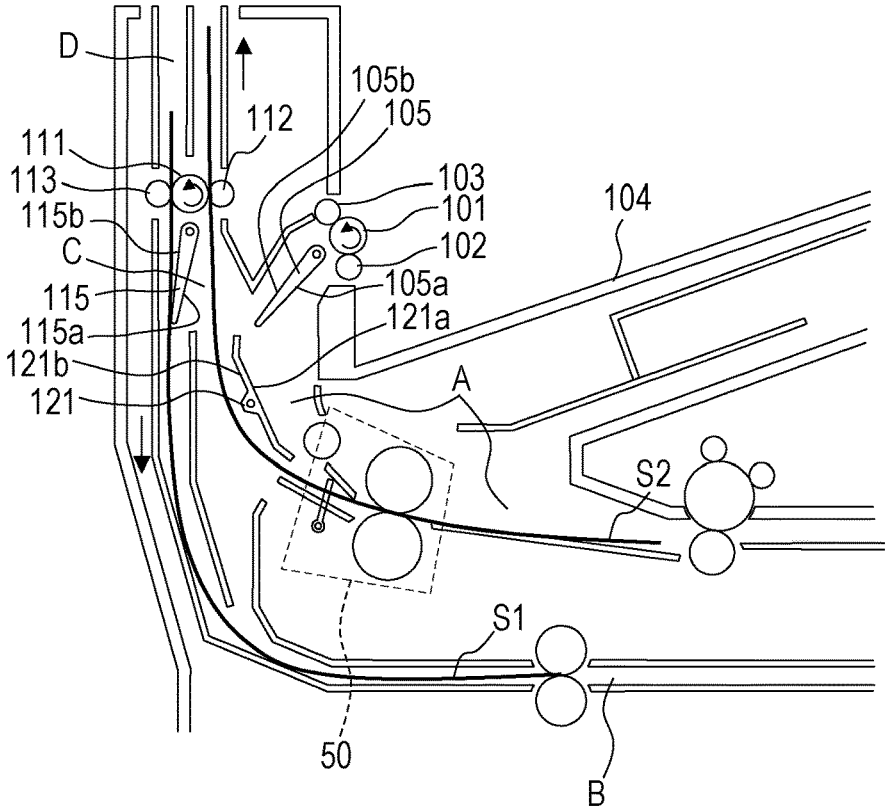

Note that as illustrated in FIG. 3D, in the configuration of the second discharge sheet reversing portion 110 of the present embodiment, the second sheet S2 can be conveyed towards the sheet discharge tray 114 while the first sheet S1 is conveyed and reversed from the reverse path D towards the reverse path B. As described above, by having two continuously fed sheets S be conveyed so as to pass by each other, performance of conveying the sheet S can be refined.

In the configuration of the present embodiment, as illustrated in FIG. 1, the second discharge sheet reversing portion 110 is provided downstream of an intersection point BC at which the conveyance path C and the reverse path B intersect each other. Furthermore, as illustrated in FIG. 3D, since the second discharge sheet reversing portion can convey the second sheet S2 towards the sheet discharge tray 114 while reversing the first sheet S1, a hindrance in the performance of conveying the sheet S can be suppressed with respect to the configuration of a comparative example.

Furthermore, in the configuration of the present embodiment, when the second sheet S2 is discharged to the sheet discharge tray 104, the first sheet S1 can be reversed with the first discharge sheet reversing portion 100, and when the second sheet S2 is discharged to the sheet discharge tray 114, the first sheet S1 can be reversed with the second discharge sheet reversing portion 110. When conveying the continuously fed sheets S, by conveying the sheets S in the above manner, the plurality of sheets S can be reversed and made to pass by each other at the first discharge sheet reversing portion 100 or at the second discharge sheet reversing portion 110; accordingly, the sheets S can be conveyed efficiently. However, not limited to the above, when discharging the second sheet S2 to the sheet discharge tray 104, the reversing of the first sheet S1 can be performed with the second discharge sheet reversing portion 110, and the discharging of the second sheet S2 to the sheet discharge tray 104 can be performed with the first discharge sheet reversing portion 100.

In the present embodiment, a description of the second discharge sheet reversing portion 110 including three series of rollers, namely, the reverse roller 113, the driving roller 111, and the sheet discharge roller 112 has been given; however, the second discharge sheet reversing portion 110 is not limited to such a configuration. For example, two pairs of rollers, each pair constituted by a driving roller and a driven roller, may perform the reversing of the sheet S and the conveyance of the sheet S, and a flapper serving as a third guiding member may be provided between the two pairs of rollers to guide the conveyed sheets S.

Pivot Configuration of Flapper 121

Figure 4A:
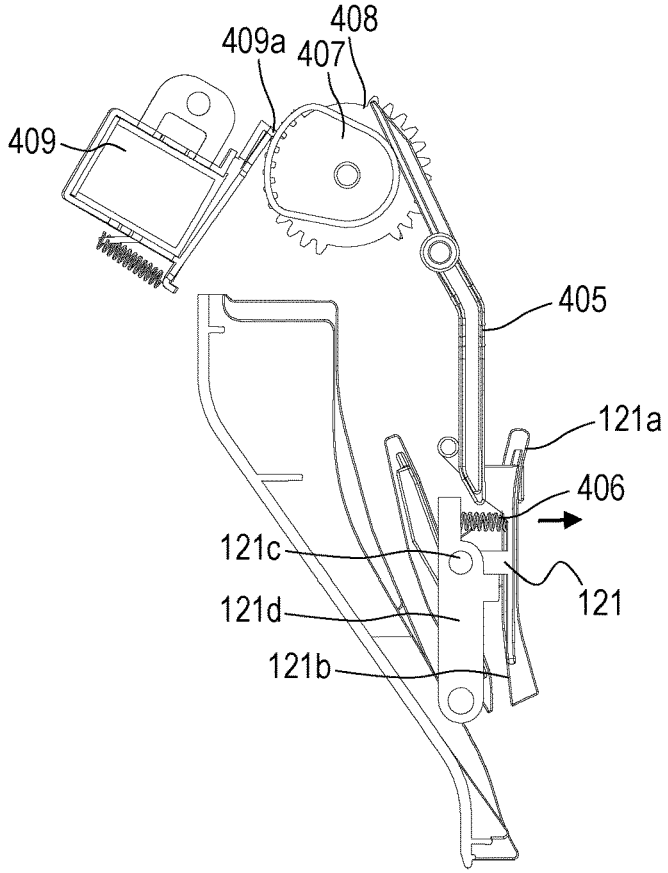
FIGS. 4A and 4B are schematic diagrams illustrating a mechanism that moves a first guiding member according to the first embodiment.
Figure 4B:
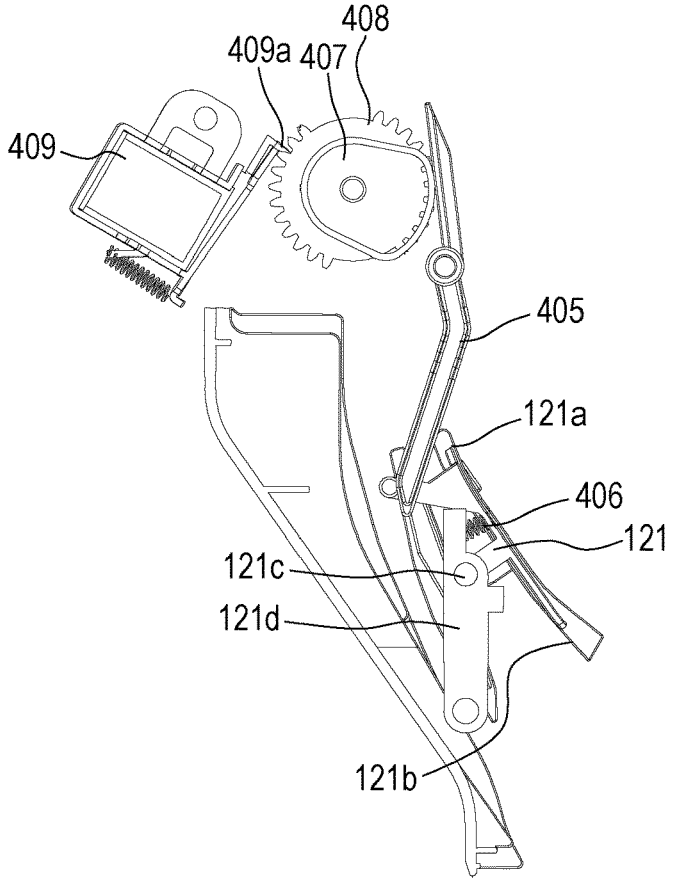
Figure 5:
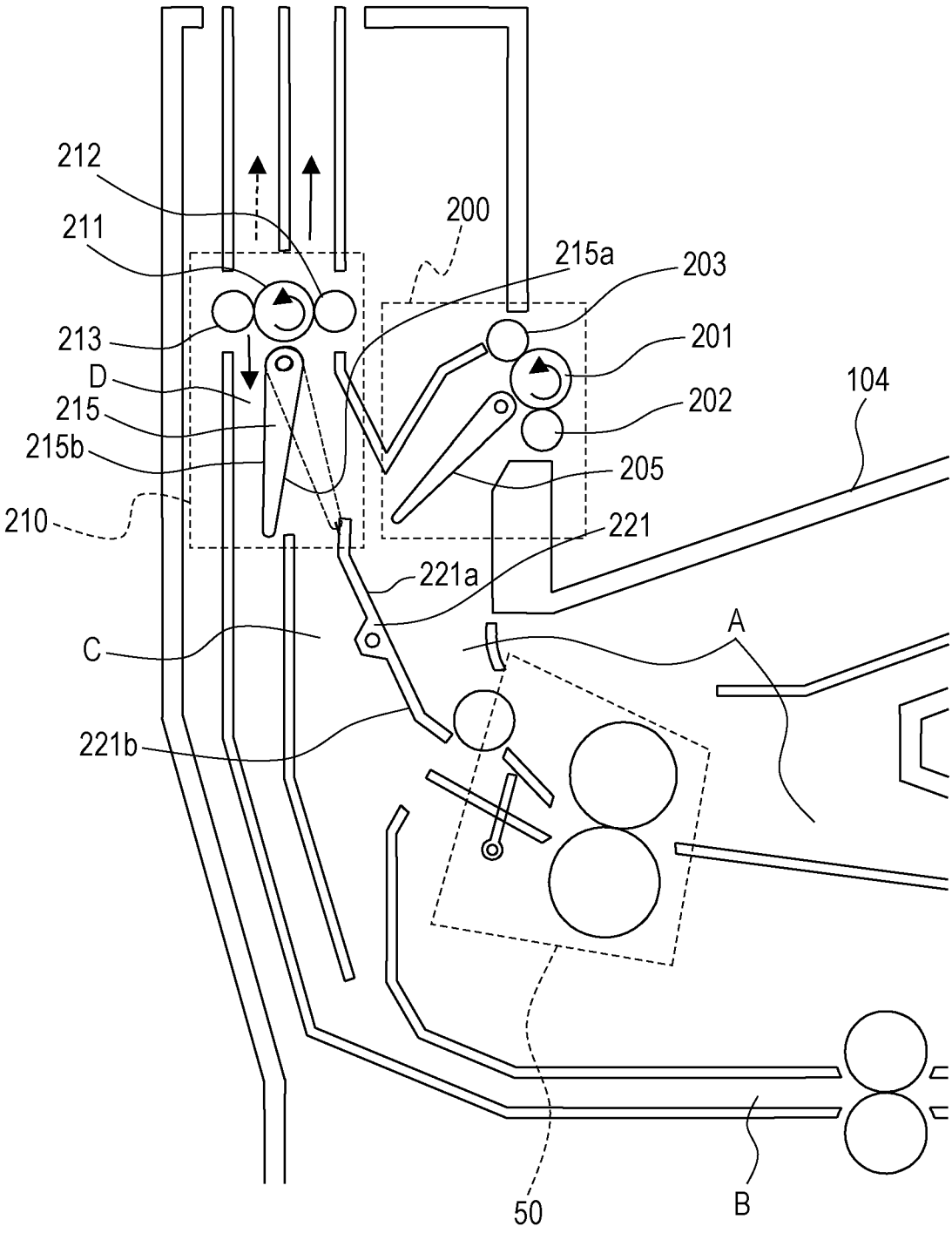
FIG. 5 is a schematic diagram illustrating configurations of a first discharge sheet reversing portion and a second discharge sheet reversing portion according to a second embodiment.

Referring next to FIGS. 4A and 4B, a mechanism of pivoting the flapper 121 from the first state to the second state will be described. FIG. 4A is a schematic diagram illustrating the flapper 121 in the first state and a flapper pivoting mechanism 400, and FIG. 4B is a schematic diagram illustrating the flapper 121 in the second state and the flapper pivoting mechanism 400.

As illustrated in FIGS. 4A and 4B, the flapper 121 includes a pivot shaft 121*c* (a first pivot shaft) that pivots from the first state to the second state, and guide arms 121*d* serving as supporting portions that support both ends of the pivot shaft 121*c*. Both ends of the guide surface 121*a* and the guide surface 121*b* of the flapper 121 in a direction that intersects an axial direction of the pivot shaft 121*c* are free ends. Furthermore, the guide surface 121*a* and the guide surface 121*b* are formed on both the upstream side and the downstream side with respect to the pivot shaft 121*c* in the conveyance direction of the sheet S guided by the flapper 121. With the above configuration, the flapper 121 can guide the sheet S to the first discharge sheet reversing portion 100 with the guide surface 121*a* and can guide the sheet S to the second discharge sheet reversing portion 110 with the guide surface 121*b*.

When discharging the sheet to the sheet discharge tray 104, a switch ring 405 that serves as a switching member abutting against the flapper 121 is maintained at the first position illustrated in FIG. 4A. In the above, the flapper 121 is biased in a direction of the arrow in the figure with springs 406. Furthermore, in the first position, the switch ring 405 is adjacent to a switching cam 407. The switching cam 407 includes a coaxial partially-toothless gear 408 and an engagement portion (not shown). The position of the switching cam 407 is maintained by having the engagement portion engage with an arm portion 409*a* of a solenoid 409. Note that in the present embodiment, the flapper pivoting mechanism 400 that pivots the flapper 121 from the first state to the second state includes the switch ring 405, the springs 406, the switching cam 407, the partially-toothless gear 408, and the solenoid 409.

When the flapper 121 is pivoted from the first state to the second state, the switch ring 405 serving as the switching member that abuts against the flapper 121 moves to the second position illustrated in FIG. 4B. More specifically, by applying power to the solenoid 409, the engagement between the arm portion 409*a* and the engagement portion (not shown) is cancelled, and a drive is transmitted to the partially-toothless gear 408 to rotate the switching cam 407. With the above, the switching cam 407 is rotated. In so doing, by having the arm portion 409*a* of the solenoid 409 engage with an engagement portion (not shown) that is different from the engagement portion in the engaged state in FIG. 4A, the rotation of the switching cam 407 is stopped while the position illustrated in FIG. 4B is reached. By having the switching cam 407 bias the switch ring 405 and, further, by having the switch ring 405 bias the flapper 121, the flapper 121 is switched from the first state to the second state.

Second Embodiment

As illustrated in FIGS. 5 to 8B, in a second embodiment, configurations of a flapper 205, a flapper 215, and a flapper 221 that serve as guiding members are different from the configurations of the flapper 105, the flapper 115, and the flapper 121 that serve as the guiding members of the first embodiment. Note that in the description hereinafter, configurations and operations that are common with those of the first embodiment are denoted with the same reference numerals and description thereof is omitted. The configurations and operations that are different from those of the first embodiment will be described mainly.

Figure 8A:
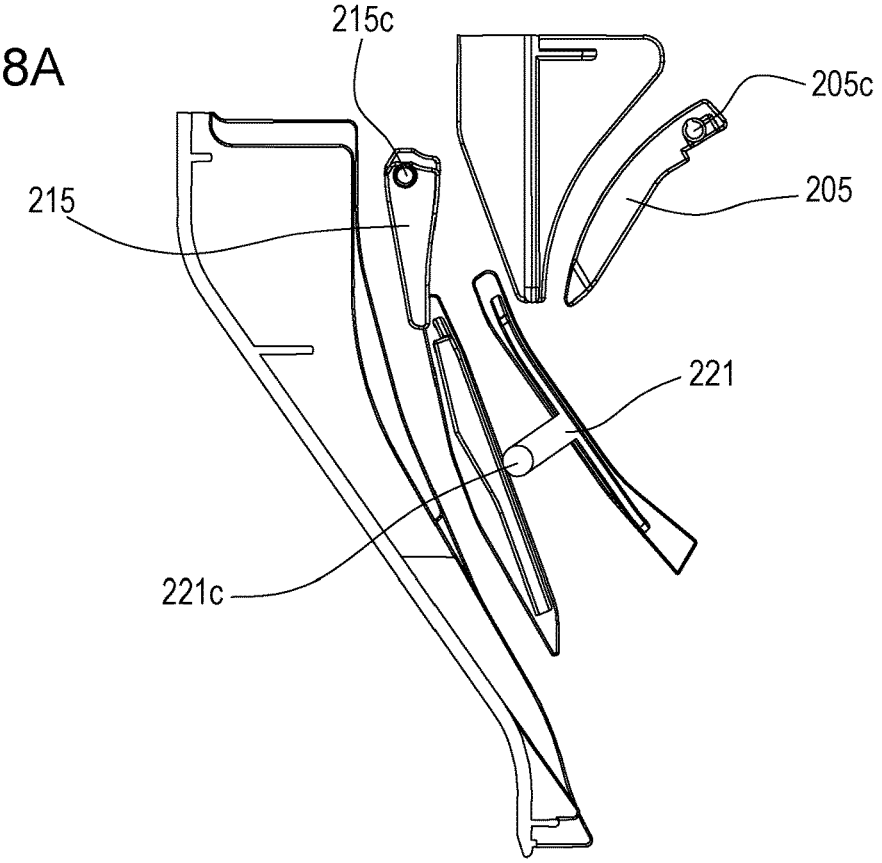
FIGS. 8A and 8B are schematic diagrams illustrating a configuration and an operation of the guiding members according to the second embodiment when a sheet is conveyed to the second discharge sheet reversing portion.
Figure 8B:
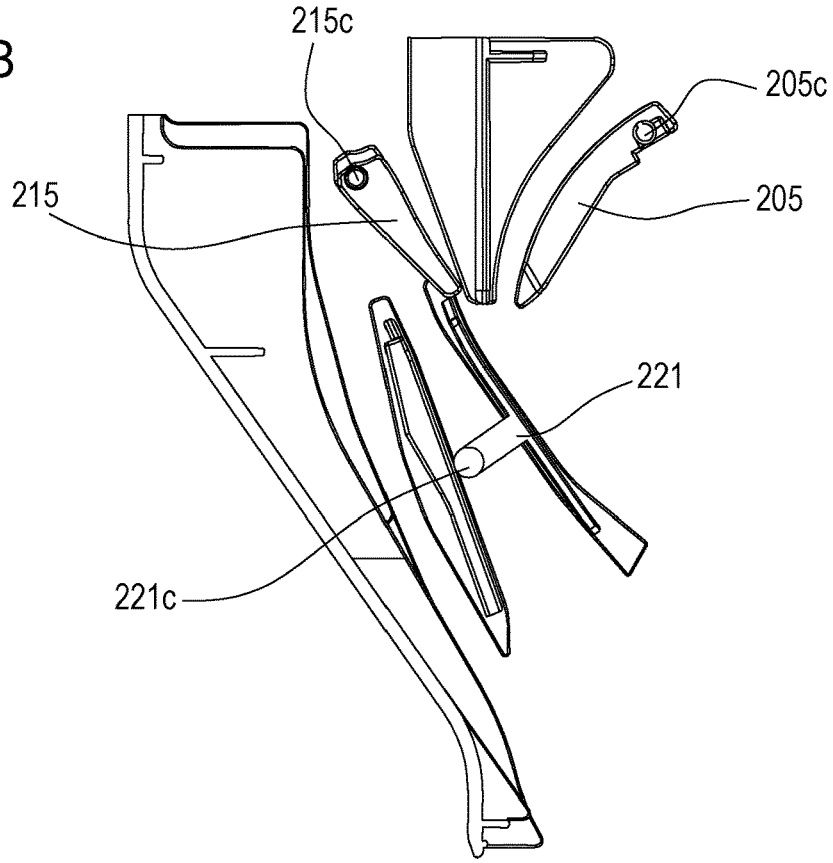

FIGS. 8A and 8B are schematic diagrams illustrating configurations of a first discharge sheet reversing portion 200 (a first conveyance unit), a second discharge sheet reversing portion 210 (a second conveyance unit), and the flapper 221 (a first guiding member) according to the present embodiment. As illustrated in FIGS. 8A and 8B, the flapper 205 and the flapper 215 are configured so that a portion of each overlaps the flapper 221.

As illustrated in FIGS. 8A and 8B, the first discharge sheet reversing portion 200 includes a driving roller 201 (a first rotating member), a sheet discharge roller 202 (a second rotating member), a reverse roller 203 (a third rotating member), and the flapper 205 (a second guiding member). Furthermore, the second discharge sheet reversing portion 210 includes a driving roller 211 (a fourth rotating member), a sheet discharge roller 212 (a fifth rotating member), a reverse roller 213 (a sixth rotating member), and the flapper 215 (a third guiding member). Note that the sheets S are conveyed in the first discharge sheet reversing portion 200 and the second discharge sheet reversing portion 210 in a similar manner to that in the first embodiment.

Figure 6A:
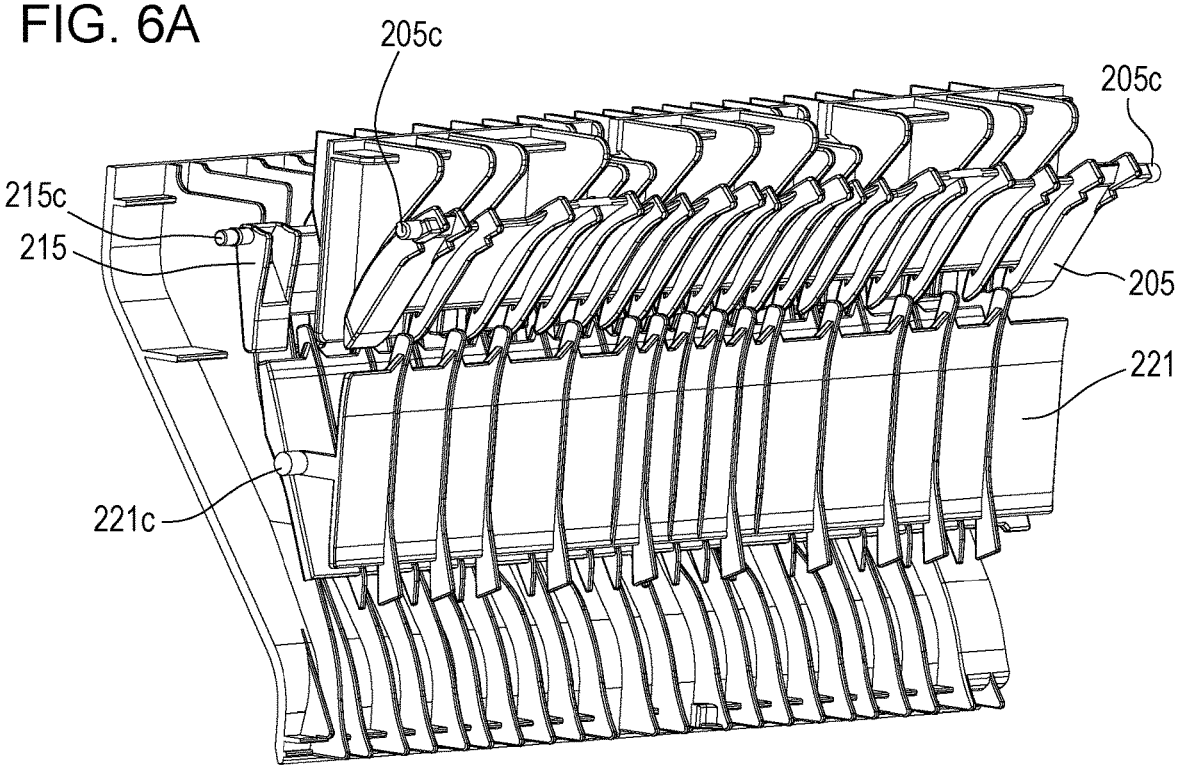
FIGS. 6A and 6B are schematic diagrams illustrating a comb-teeth configuration of guiding members according to the second embodiment.
Figure 6B:
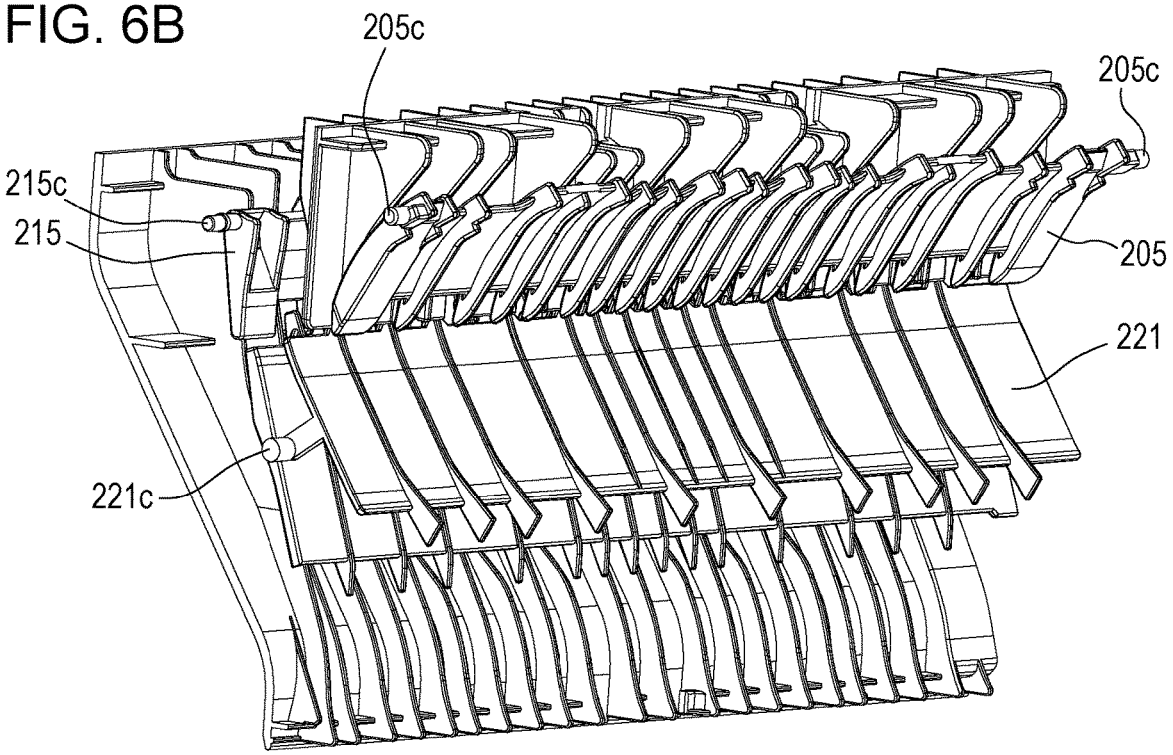
Figure 7A:
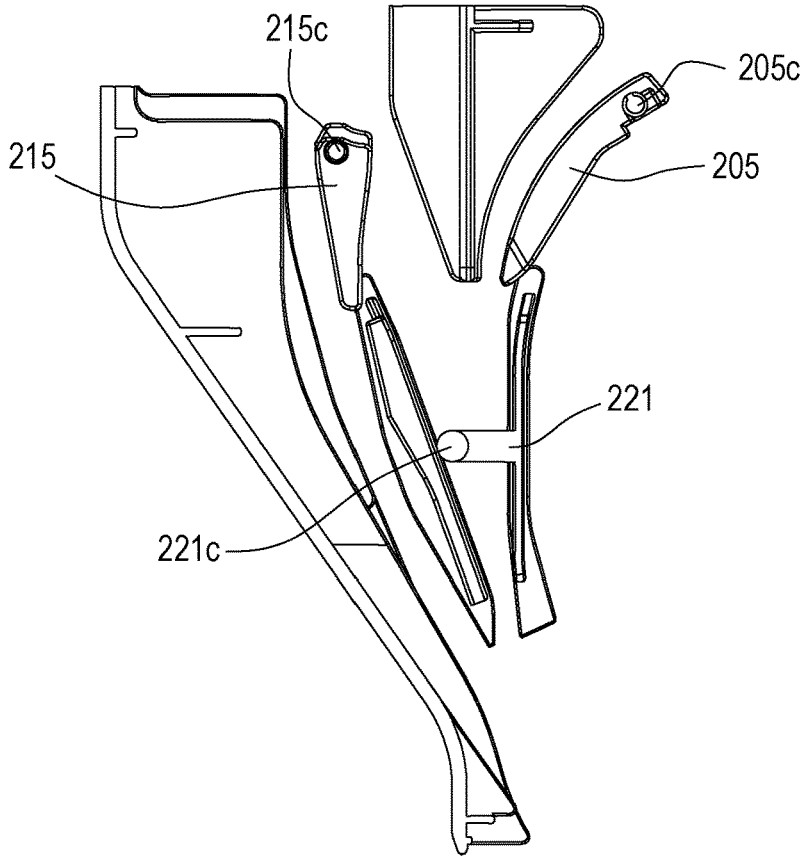
FIGS. 7A and 7B are schematic diagrams illustrating a configuration and an operation of the guiding members according to the second embodiment when a sheet is conveyed to the first discharge sheet reversing portion.
Figure 7B:
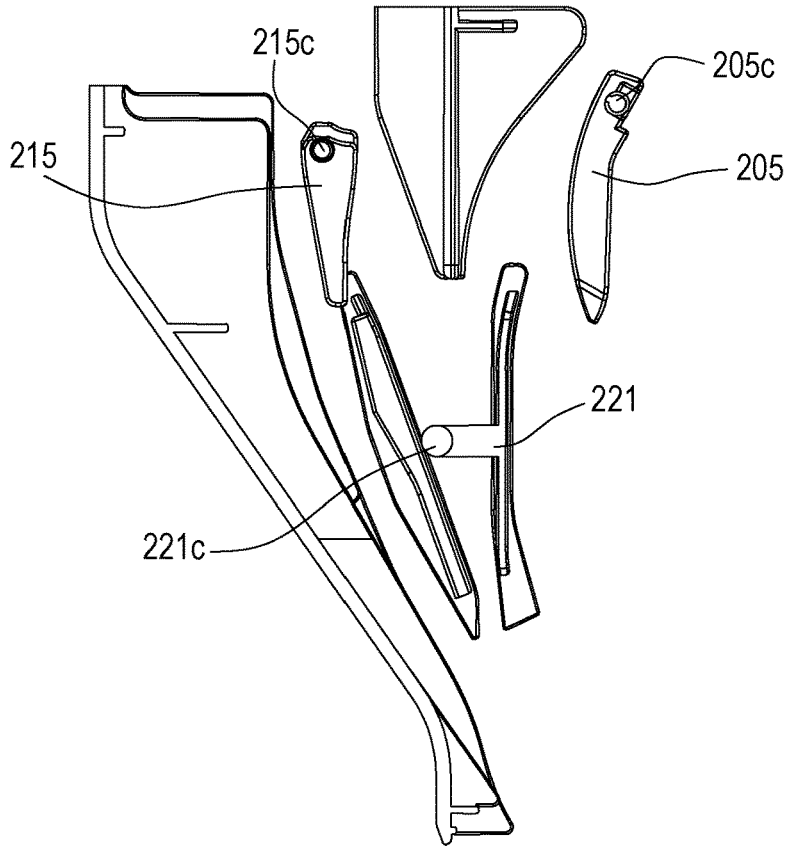

FIG. 6A is a schematic diagram illustrating that the flapper 205 and the flapper 221 each have a comb-teeth configuration, and FIG. 6B is a schematic diagram illustrating that the flapper 215 and the flapper 221 each have a comb-teeth configuration. FIGS. 7A and 7B are schematic diagrams illustrating an operation of the flapper 205 when the sheet S is conveyed to the first discharge sheet reversing portion 200, and FIGS. 8A and 8B are schematic diagrams illustrating an operation of the flapper 205 when the sheet S is conveyed to the second discharge sheet reversing portion.

As illustrated in FIG. 6A, in the sheet conveyance direction when the sheet S is conveyed from the conveyance path A to the first discharge sheet reversing portion 200 (illustrated in FIG. 5), the upstream side of the flapper 205 and the downstream side of the flapper 221 have comb-teeth configurations that intersect each other. With the above, as illustrated in FIG. 7A, the comb-teeth portions of the flapper 205 and the flapper 221 can overlap each other. As a result, during the operation of the flapper 205, contact between the flapper 205 and the flapper 221 can be suppressed, and generation of abnormal noise and exhaustion of the components can be suppressed. Furthermore, owing to the comb-teeth configuration, since there will be no vacant spaces on the conveyance path of the sheet S when in a state illustrated in FIG. 7A, error in conveying the sheet S and sheet jamming can be suppressed.

Moreover, as illustrated in FIG. 6B, in the sheet conveyance direction when the sheet S is conveyed from the conveyance path A to the second discharge sheet reversing portion 210 (illustrated in FIG. 5), the upstream side of the flapper 215 and the downstream side of the flapper 221 have comb-teeth configurations that intersect each other. With the above, as illustrated in FIG. 8A, the comb-teeth portions of the flapper 215 and the flapper 221 can overlap each other, and generation of abnormal noise and exhaustion of the components can be suppressed during the operation of the flapper 215; accordingly, the sheet S can be conveyed in a stable manner.

As described above, in the configuration of the present embodiment, an effect that is similar to that of the first embodiment can be obtained, generation of abnormal noise and exhaustion of the components can be suppressed during the operation of the flapper 205, the flapper 215, and the flapper 221 that serve as guiding members, and the sheet S can be conveyed in a stable manner.

Figure 9:
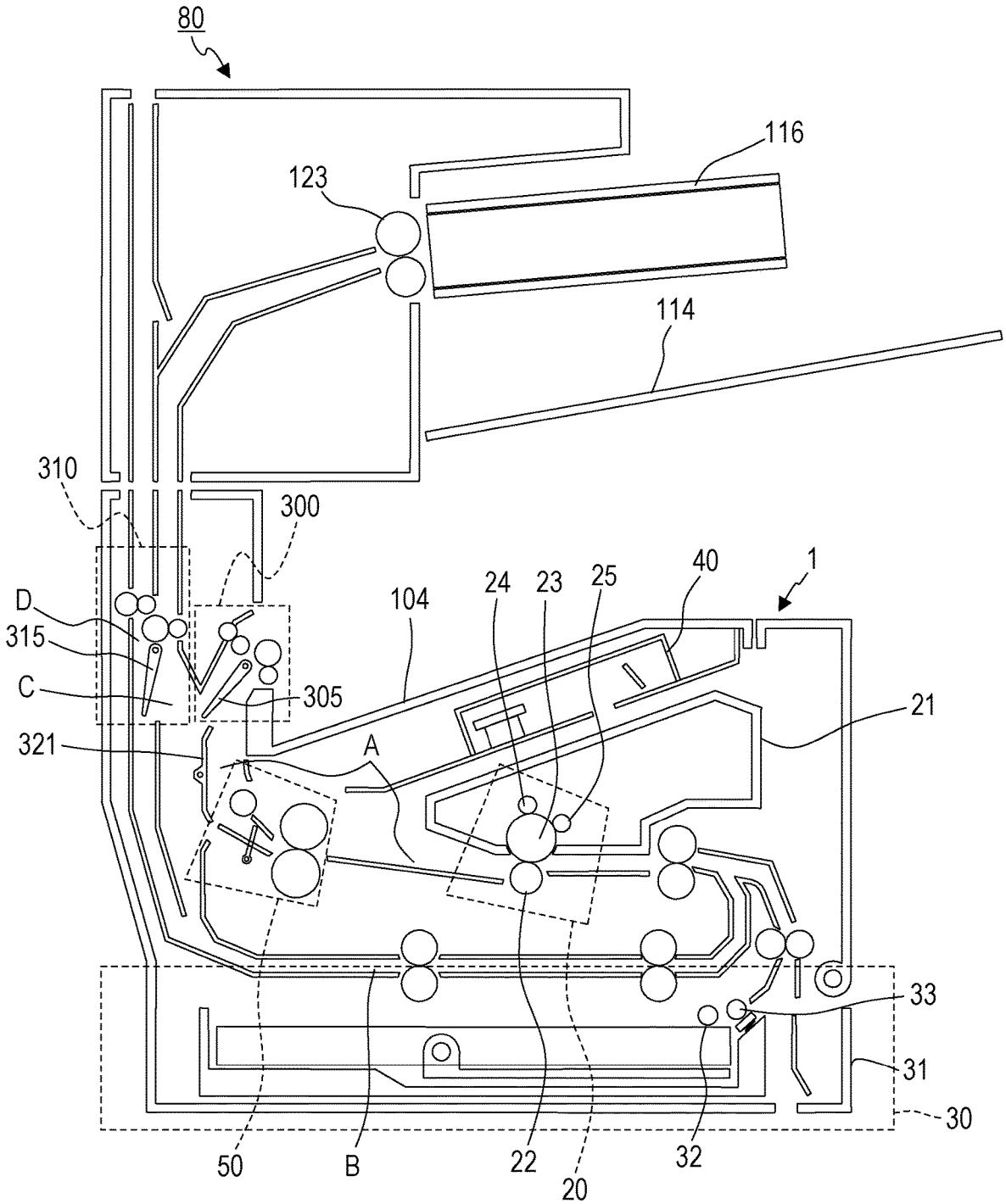
FIG. 9 is a schematic cross-sectional view illustrating a configuration of an image forming apparatus of a modification.

In the present embodiment, a configuration including three series of rollers has been described as the first discharge sheet reversing portion and the second discharge sheet reversing portion; however, the configuration is not limited to the above. For example, as illustrated in a modification in FIG. 9, the conveyance of the sheet S may be performed with two pairs of rollers in a first discharge sheet reversing portion 300 or in a second discharge sheet reversing portion 310.

Third Embodiment

In the first and second embodiments, the description has been given using the image forming unit 1 including, on the upper portion thereof, the image reading portion 80, the sheet processing unit 116 including the aligning mechanism that aligns the sheets S and the staple mechanism, and the sheet discharge tray 114 serving as the second stack portion on which the sheets S are stacked. However, not limited to the above, the present disclosure can be applied to an image forming apparatus in which the image reading portion 80, the sheet processing unit 116, and the sheet discharge tray 114 are provided as options.

Figure 10A:
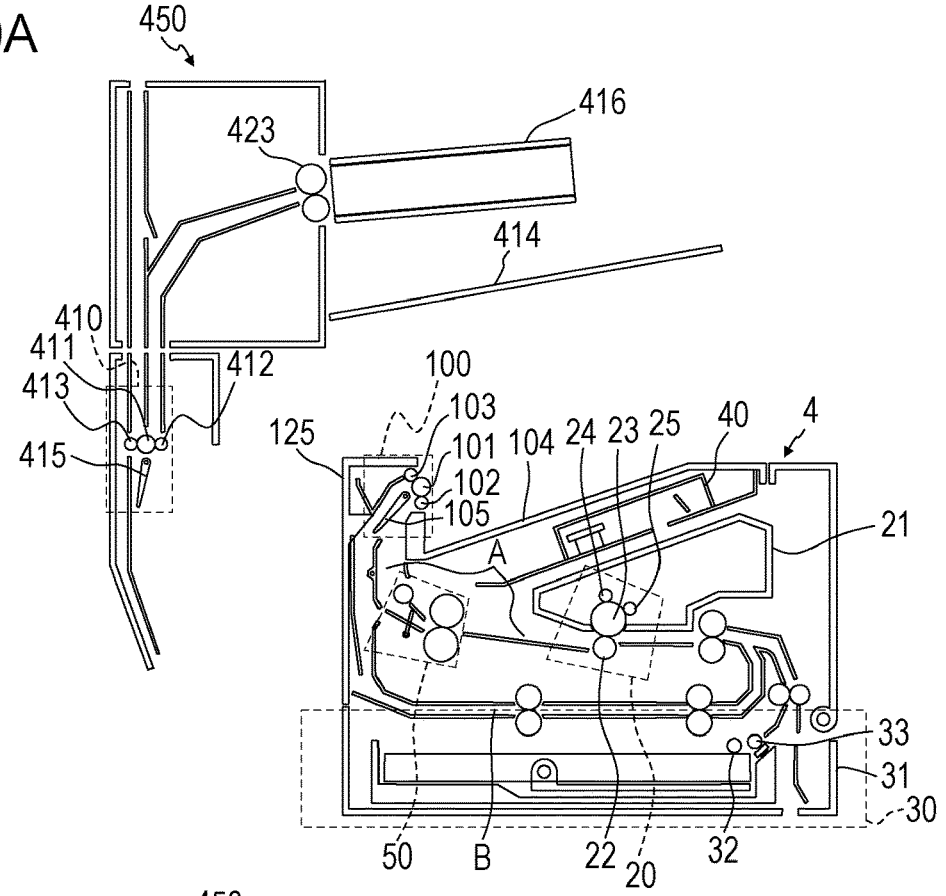
FIGS. 10A and 10B are schematic cross-sectional views illustrating a configuration of an image forming apparatus according to a third embodiment.
Figure 10B:
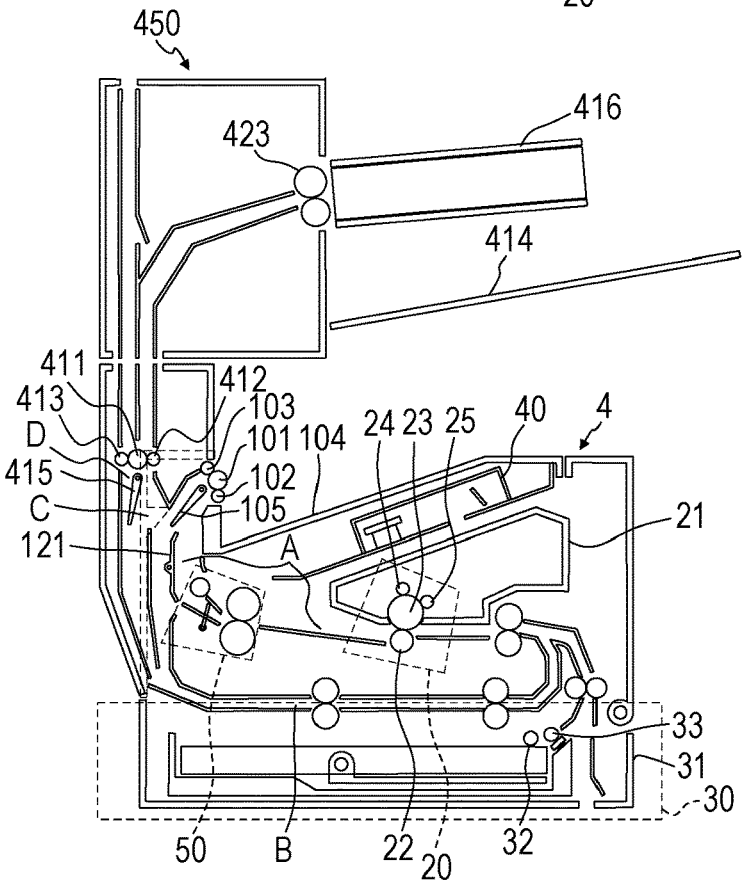

Referring hereinafter to FIGS. 10A and 10B, a configuration of the present embodiment in which an option 450 is provided in an image forming apparatus 4 will be described. Note that while in the present embodiment, a description of the option 450 including a sheet discharge tray 414 serving as the second stack portion and a sheet processing unit 416 will be given, the configuration of the option 450 is not limited to the that and may be one without the sheet processing unit 416 or may be one that includes the image reading portion 80.

FIG. 10A is a schematic cross-sectional view illustrating the configuration of the option 450 and the image forming apparatus 4 before the option 450 is mounted on the image forming apparatus 4, and FIG. 10B is a schematic cross-sectional view illustrating the configuration of the image forming apparatus 4 after the option 450 has been mount thereon. Note that in the description hereinafter, portions that are common with the image forming apparatuses 1 of the first and second embodiments will be attached with the same reference numerals and description thereof will be omitted.

As illustrated in FIG. 10A, the first discharge sheet reversing portion 100 serving as the first conveyance unit is provided in the image forming apparatus 4, and a second discharge sheet reversing portion 410 serving as the second conveyance unit is provided in the option 450. Furthermore, the image forming apparatus 4 includes a rear door 125 capable of exposing the reverse path B by being opened. By dismounting the rear door 125 and mounting the option 450, as illustrated in FIG. 10B, the image forming apparatus 4 including the first discharge sheet reversing portion 100 and the second discharge sheet reversing portion 410 can be obtained.

Fourth Embodiment

In the first embodiment, the description of the configuration of the second discharge sheet reversing portion 110 including the three series of rollers, namely, the reverse roller 113, the driving roller 111, and the sheet discharge roller 112 has been given. In the present embodiment, an image forming apparatus 11 includes a second discharge sheet reversing portion 510 that conveys the sheets to the sheet processing unit 116 that includes the aligning mechanism that aligns the sheets S and the staple mechanism. The second discharge sheet reversing portion 510 includes the driving roller 111 that is rotated by receiving driving force from a drive source (not shown), and a conveyance roller 112 that is rotated by following the rotation of the driving roller 111.

Figure 11:
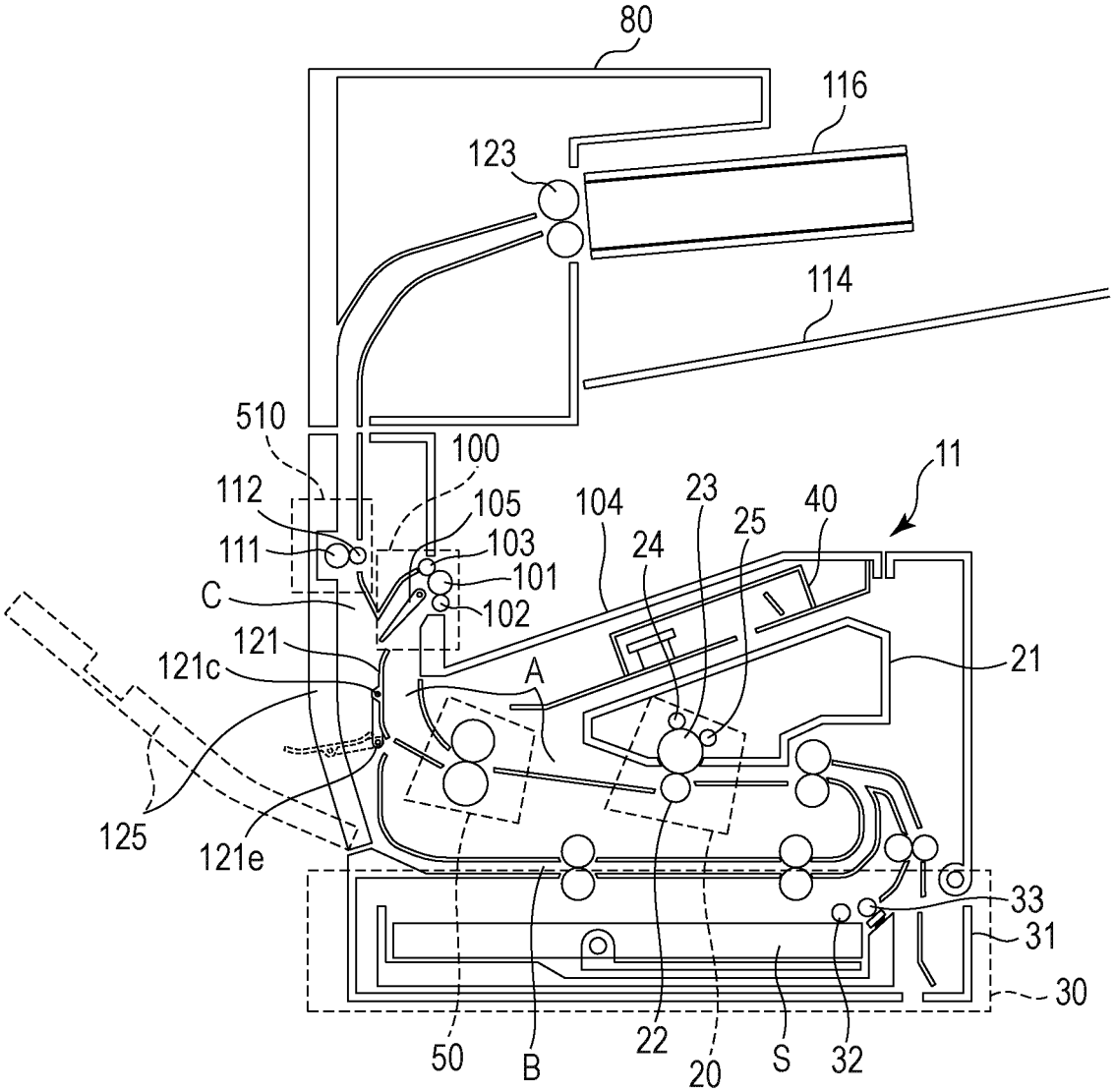
FIG. 11 is a schematic cross-sectional view illustrating a configuration of an image forming apparatus of a fourth embodiment.

The image forming apparatus 11 of the present embodiment includes a rear door 125 to remove the sheet S, conveyed towards the first discharge sheet reversing portion 100 or the second discharge sheet reversing portion 110, stuck and remaining (hereinafter, referred to as jammed) in either of the conveyance paths. As illustrated in FIG. 11, the rear door 125 is an opening and closing member that is capable of exposing the conveyance path C by being pivoted to a position illustrated by a broken line in the drawing from a position illustrated by a solid line in the drawing. The user can remove the remaining sheet S by opening the rear door 125. Note that components other that the above is similar to those of the image forming apparatus 1 of the first embodiment; accordingly, the description is given while the similar components are denoted with the same reference numerals.

Figure 12A:
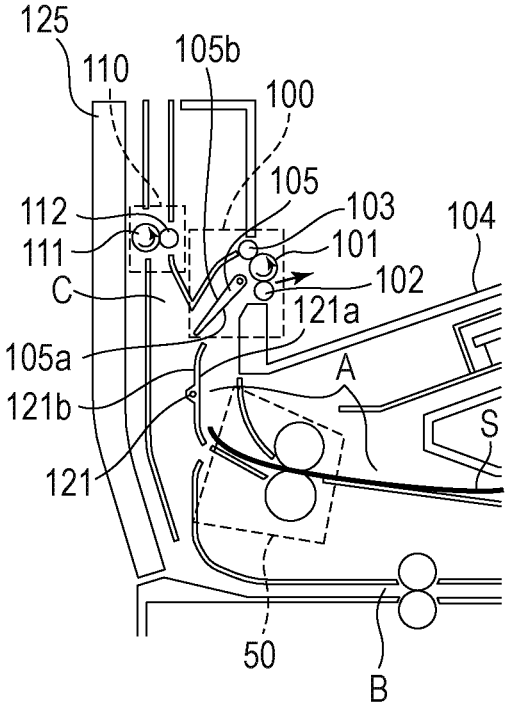
FIGS. 12A to 12D are schematic diagrams illustrating conveyance of a sheet to a plurality of conveyance paths according to the fourth embodiment.
Figure 12B:
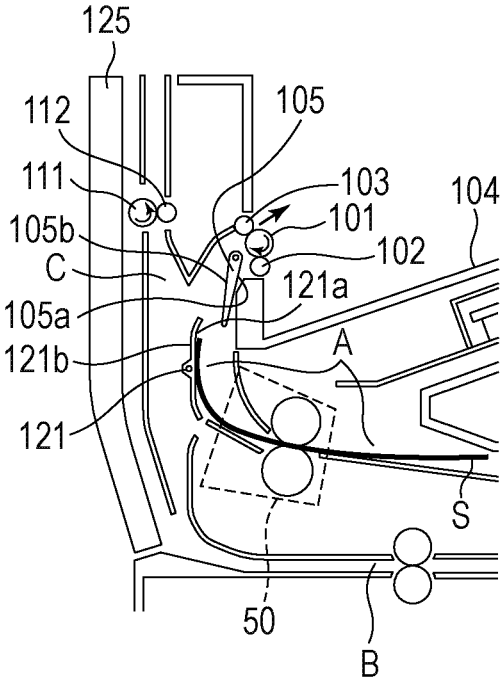
Figure 12C:
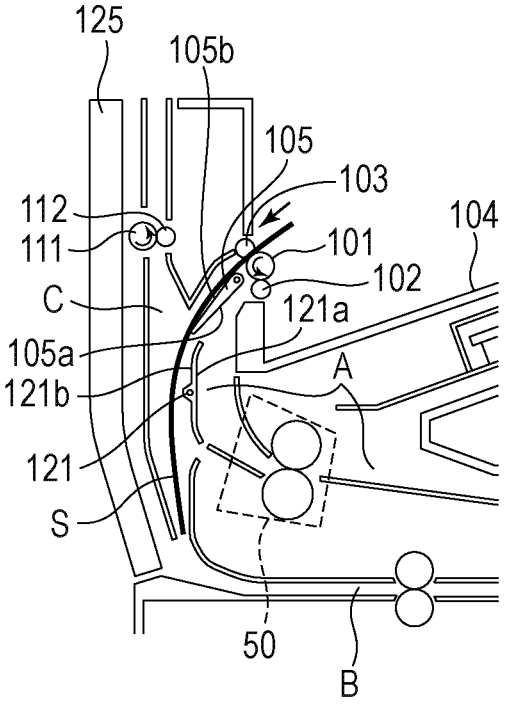
Figure 12D:
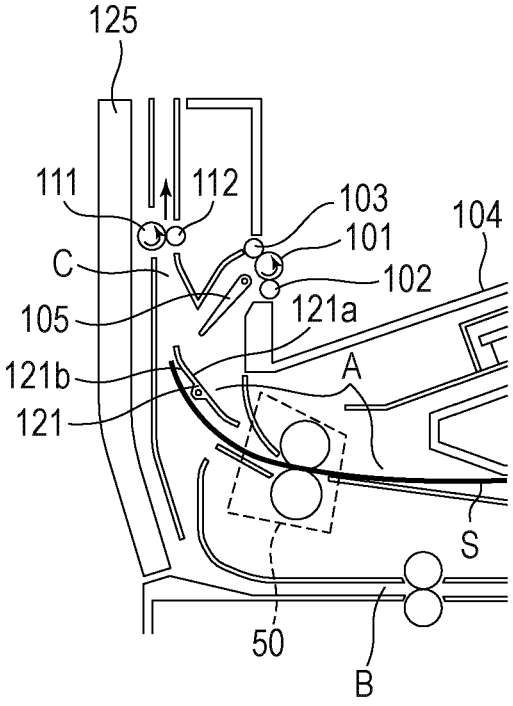

Referring next to FIG. 12D, a case in which the sheet S is conveyed towards the conveyance path C will be described. The second discharge sheet reversing portion 110 is a discharge unit that is provided in the conveyance path C for discharging the sheet S towards the sheet discharge tray 114. The second discharge sheet reversing portion 110 includes the driving roller 111 and the conveyance roller 112. Receiving driving force from a drive source (not shown), the driving roller 111 is rotated, and following the rotation of the driving roller 111, the conveyance roller 112 is rotated. When the sheet S is conveyed towards the conveyance path C, first, the flapper 121 is pivoted from a first state illustrated in FIG. 12A to a second sate illustrated in FIG. 12D. With the above, the sheet S conveyed from the fixing portion 50 is discharged to the sheet discharge tray 114 after being guided by the guide surface 121*b* of the flapper 121 and being conveyed towards the second discharge sheet reversing portion 110.

Note that in a case in which the sheet S is discharged to the sheet discharge tray 114 after images are formed on both surfaces of the sheet S, rather than reversing the sheet S in the first discharge sheet reversing portion 100, the sheet S may be reversed in the second discharge sheet reversing portion 510. In such a case, the flapper 121 is pivoted from the second state to the first state after the rear edge of the sheet S has passed the edge of the flapper 121 on the downstream side in the conveyance direction of the sheet S conveyed towards the conveyance path C, and the rotation direction of the driving roller 111 is switched to the counterclockwise direction. With the above, the sheet S is conveyed towards the reverse path B with the driving roller 111 and the conveyance roller 112, and formation of an image can be performed again in the image forming portion 20.

Jam Recovery Method

Figure 13:
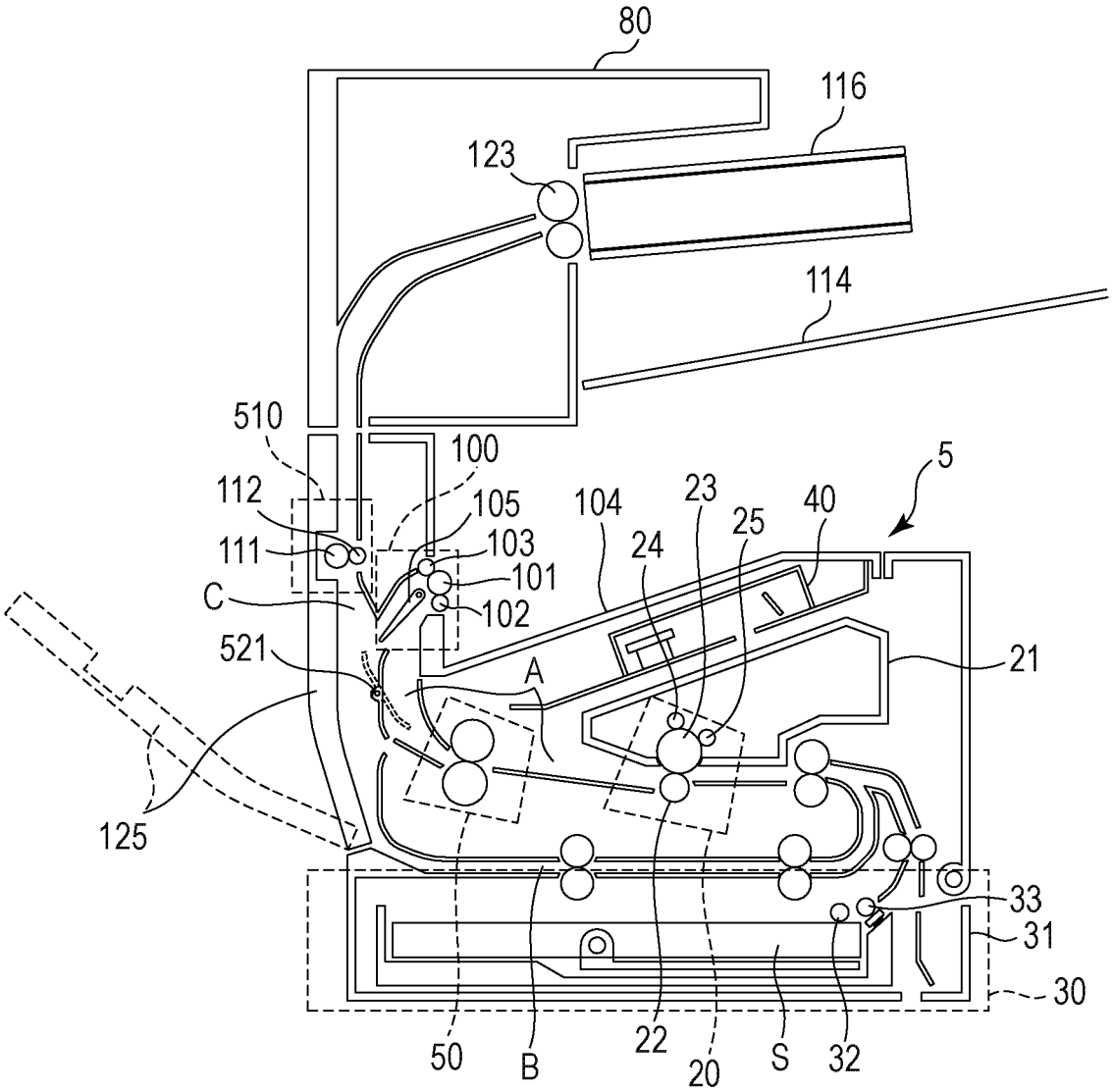
FIG. 13 is a schematic diagram illustrating a mechanism that moves the first guiding member according to a comparative example of the fourth embodiment.

FIG. 13 is a schematic cross-sectional view of an image forming apparatus 5 serving as a comparative example of the present embodiment. Note that since the configuration of the image forming apparatus 5 of the comparative example is similar to that of the present embodiment except for a pivoting configuration of a flapper 521, common components are attached with the same reference numerals and description thereof is omitted.

As illustrated in FIG. 13, the flapper 521 guides the conveyed sheet S towards the sheet discharge tray 104 or 114 by pivoting to a state illustrated by a solid line in the drawing or a state illustrated by a broken line in the drawing. When a sheet jamming occurs in such a configuration, depending on the position where the sheet S remains in the conveyance path, the following issue occurs.

For example, in a case in which the sheet S remains in the conveyance path C, the remaining sheet can be easily removed by opening the rear door 125 and exposing the conveyance path C. However, in a case in which the sheet S remains on the conveyance path A side that is located more on the inner side with respect to the flapper 521, even if the rear door 125 is opened, the flapper 521 will be in the way. Accordingly, in order to remove the remaining sheet S, the user pulls out the sheet S from a gap created when the flapper 521 is pivoted to the second state illustrated by a broken line in the drawing from the first state illustrated by a solid line in the drawing; however, since the sheet S is difficult to recognize visually and the work space is small, it is difficult to carry out the process. Alternatively, the flapper 521 may be configured in advance to be detachable and the user may remove the sheet S by dismounting the flapper 521; however, in such a case, the flapper 521 should be dismounted and mounted each time a sheet jamming occurs, which is troublesome.

Figure 14A:
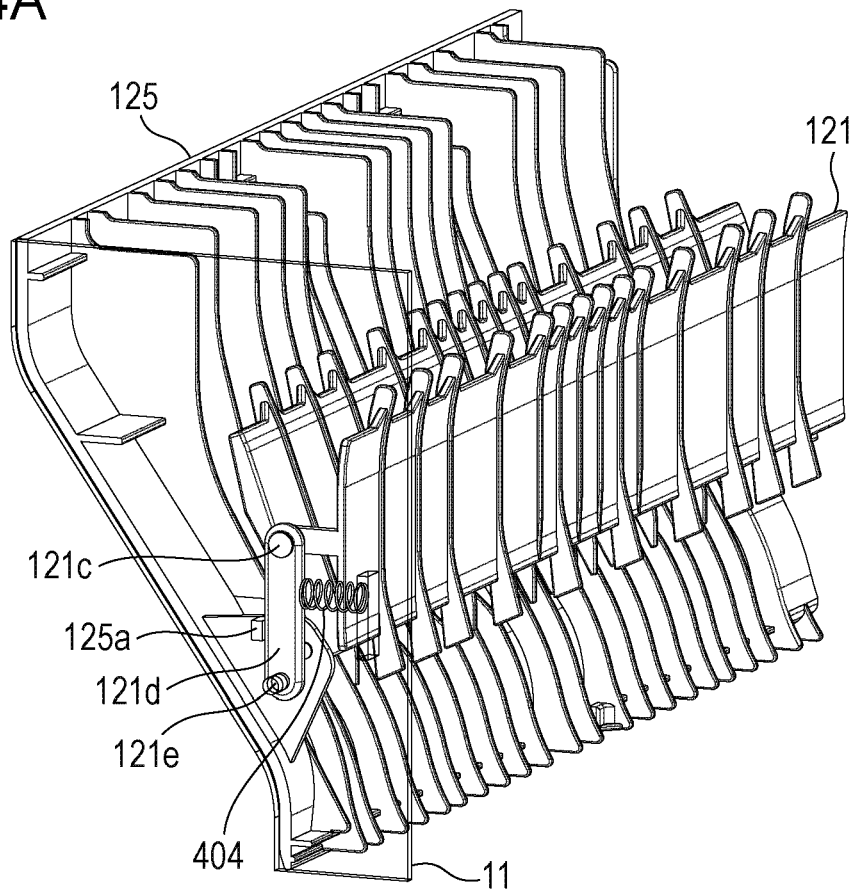
FIGS. 14A and 14B are schematic diagrams illustrating configurations of an opening and closing member and the first guiding member according to the fourth embodiment.
Figure 14B:
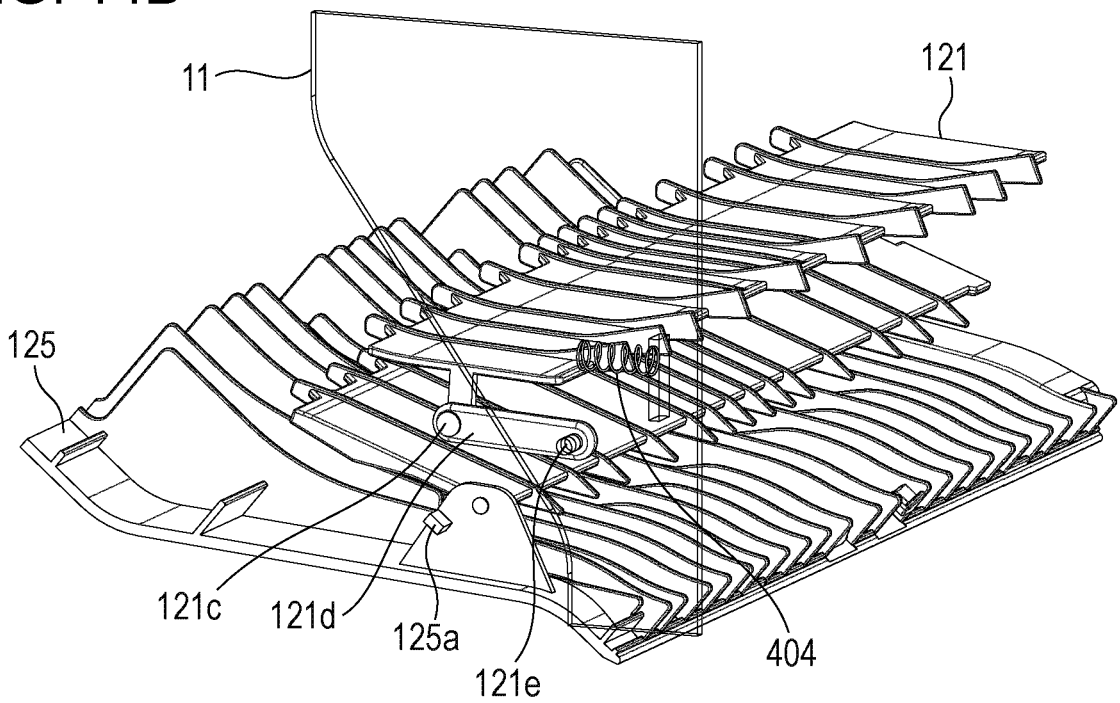

Accordingly, in the present embodiment, as illustrated in FIG. 11, when the rear door 125 is opened, the flapper 121 pivots to the position illustrated by the broken line in the figure allowing the conveyance path A to be exposed. Referring hereinafter to FIGS. 14A and 14B, the pivot operation and the configuration of the flapper 121 when opening and closing the rear door 125 will be described in detail. FIG. 14A is a schematic diagram illustrating a state of the flapper 121 when the rear door 125 is closed, and FIG. 14B is a schematic diagram illustrating a state of the flapper 121 when the rear door 125 is open.

As illustrated in FIG. 14A, the pivot shaft 121*c* of the flapper 121 is supported by the guide arms 121*d*, and the flapper 121 is capable of pivoting between the first state and the second state with the pivot shaft 121*c*. Furthermore, in the present embodiment, the guide arms 121*d* are supported by the main body of the apparatus in a state in which the guide arms 121*d* are pivotable from a position illustrated in FIG. 14A to a position illustrated in FIG. 14B with a pivot shaft 121*e* (a second pivot shaft). Furthermore, the flapper 121 is biased towards abutment portions 125*a*, which are provided in the rear door 125, with springs 404 serving as biasing members attached to the main body of the apparatus.

When the rear door 125 is opened while in a state illustrated in FIG. 14A, the abutted state between the abutment portions 125*a* and the guide arms 121*d* is cancelled, and the flapper 121 biased by the springs 404 is pivoted about the pivot shaft 121*e* towards the rear door 125. With the above, since the flapper 121 moves to a position illustrated in FIG. 14B, the conveyance path A becomes exposed as illustrated in FIG. 11.

As described above, by providing two pivot shafts 121*c* and 121*e* in the flapper 121, guiding the sheet S in a plurality of conveyance paths and exposing the conveyance path during jam recovery can both be achieved. In the present embodiment, in a state in which the rear door 125 is closed, the flapper 121 abuts against the abutment portions 125*a*; however, in a state in which the rear door 125 is open, the abutted state between the flapper 121 and the abutment portions 125*a* is cancelled and the flapper 121 is separated from the rear door 125.

Figure 15B:
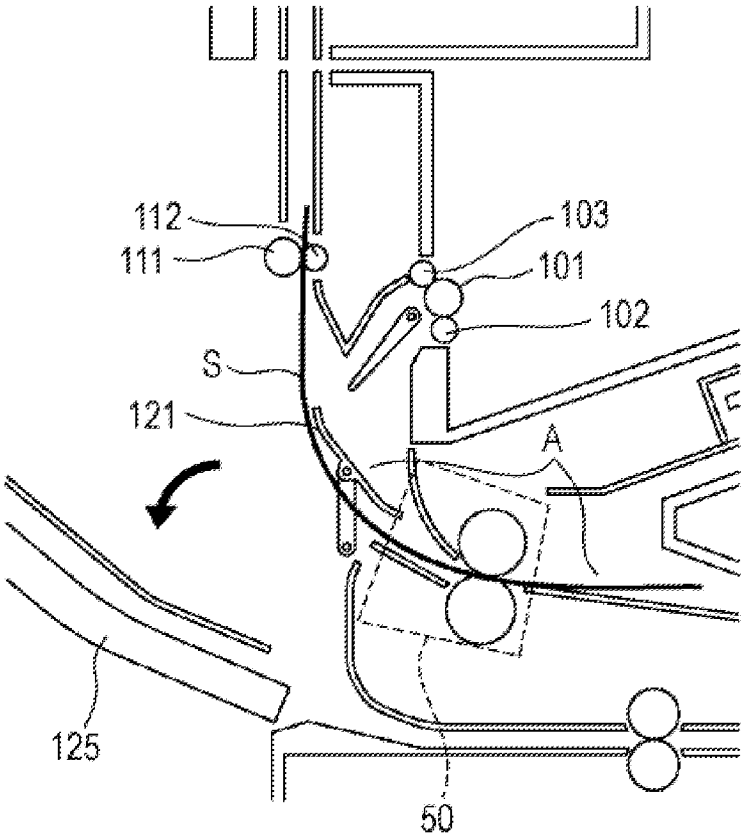
FIGS. 15A and 15B are schematic diagrams illustrating an operation carried out when performing a jam recovery in the fourth embodiment.
Figure 15A:
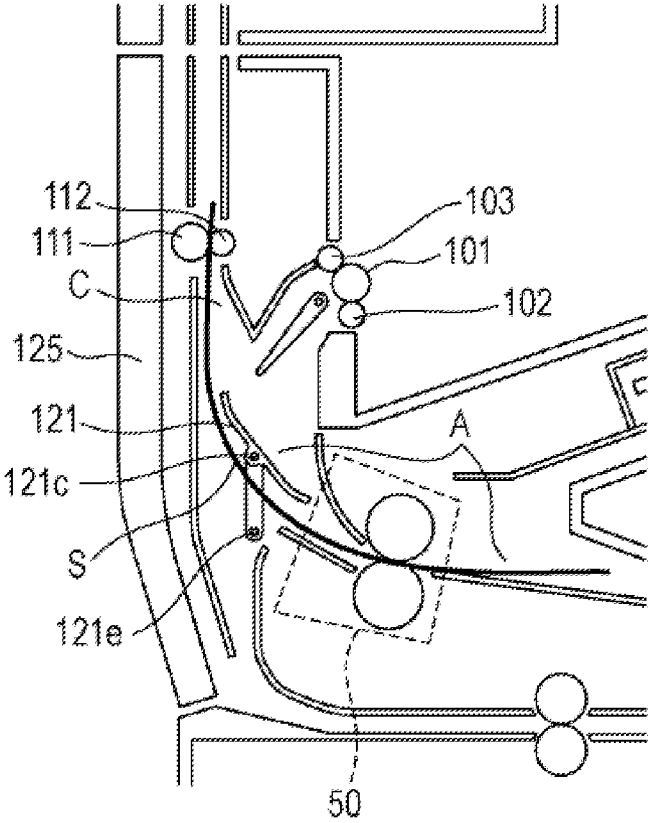
Figure 16B:
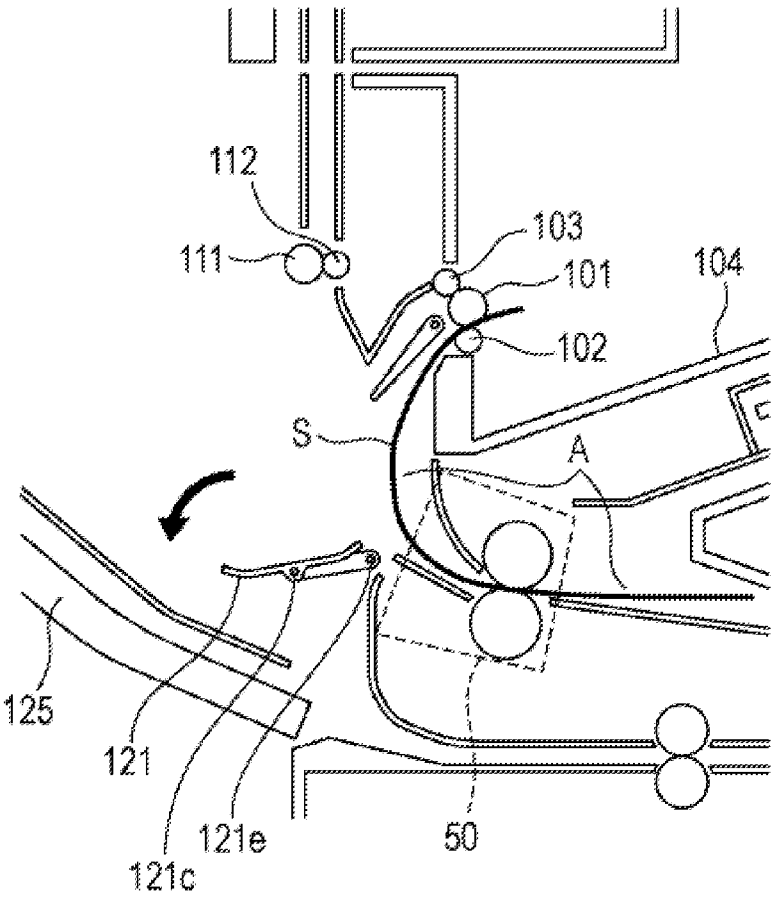
FIGS. 16A and 16B are schematic diagrams illustrating the operation carried out when performing the jam recovery in the fourth embodiment.

Referring next to FIGS. 15A to 16B, a jam recovery method in cases in which, due to the occurrence of a jamming, the sheet S remains on the conveyance path A side and the sheet S remains on the conveyance path C side will each be described. FIG. 15A is a schematic diagram illustrating a state in which the sheet S remains in the conveyance path C, and FIG. 15B is a schematic diagram illustrating a state in which the rear door 125 is opened to remove the sheet S remaining in the conveyance path C. Furthermore, FIG. 16A is a schematic diagram illustrating a state in which the sheet S remains in the conveyance path A, and FIG. 16B is a schematic diagram illustrating a state in which the rear door 125 is opened to remove the sheet S remaining in the conveyance path A.

As illustrated in FIG. 15A, in a case in which a sheet jamming has occurred while the sheet S in the conveyance path C is pinched at the second discharge sheet reversing portion 110 formed between the driving roller 111 and the conveyance roller 112, when the rear door 125 is opened, the state turns into a state illustrated in FIG. 15B from a state illustrated in FIG. 15A. Note that in the present embodiment, the biasing force of each spring 404 illustrated in FIG. 14A is adjusted so that when the sheet S remaining in the conveyance path C counters the biasing force of the springs 404, the flapper 121 does not expose the conveyance path A.

In other words, while the flapper 121 biased by the springs 404 attempts to pivot in a direction of the arrow in FIG. 15B due to the opening of the rear door 125, the flapper 121 restricted by the sheet S pinched between the second discharge sheet reversing portion 110 and the fixing portion 50 does not pivot. With the above, the user can visually recognize the remaining sheet S immediately after the rear door 125 is opened. Note that in a case in which the sheet S remains in the conveyance path C while not pinched at the second discharge sheet reversing portion, the flapper 121 pivots in the arrow direction illustrated in FIG. 15B. With the above, since the remaining sheet S is pushed by the flapper 121 and is moved to the rear door 125 side, the user can visually recognize the remaining sheet S immediately after the rear door 125 is opened. Subsequently, the user removes the remaining sheet S from the inside of the apparatus and closes the rear door 125, and the jam recovery is completed.

In the present embodiment, the easiness in visually recognizing the remaining sheet S is refined by adjusting the biasing force of the springs 404. However, not limited to the above, the flapper 121 may be configured to pivot and push the sheet S to the rear door 125 side when the rear door 125 is opened while the remaining sheet S is pinched between the second discharge sheet reversing portion 510 and the fixing portion 50.

Note that during the image-forming period, the pressure in which the fixing portion 50 pinches the sheet S is set relatively high. Accordingly, in the present embodiment, when the rear door 125 is opened, the pinched state of the fixing portion 50 interlocking with the opening operation is cancelled so that the sheet S pinched at the fixing portion 50 does not become damaged when the user pulls out the sheet S. However, the configuration of cancelling the pinched state of the fixing portion 50 during jam recovery is not limited to the above, and the pinched state of the fixing portion 50 may be cancelled at a timing when an occurrence of sheet jamming has been detected or when conveyance of the sheet S has been stopped due to the occurrence of sheet jamming.

Figure 16A:
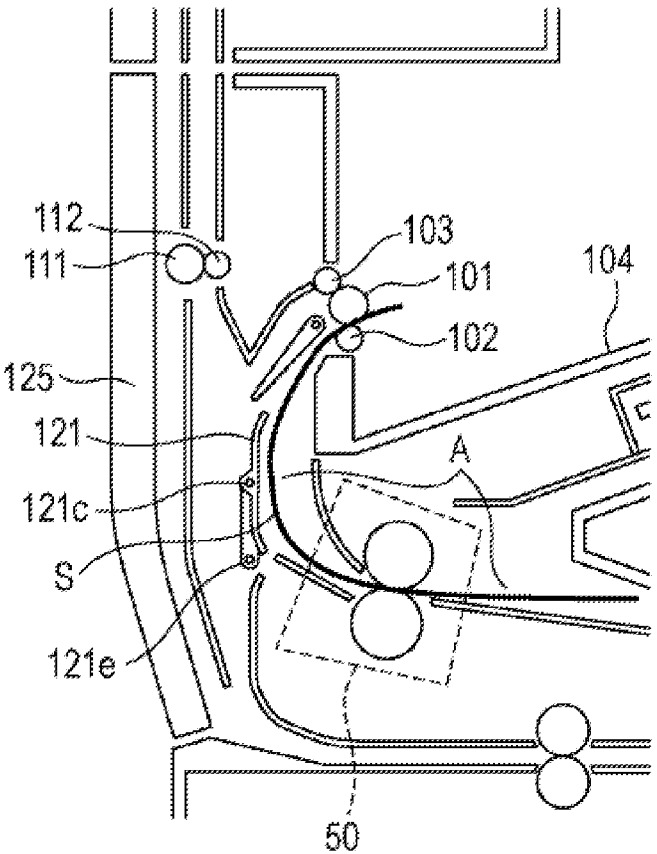

Referring next to FIGS. 16A and 16B, a case in which the sheet S has remained on the conveyance path A side will be described. As illustrated in FIG. 16A, in a case in which a sheet jamming has occurred while the sheet S in the conveyance path A is pinched at the first discharge sheet reversing portion 100, when the rear door 125 is opened, the state turns into a state illustrated in FIG. 16B from a state illustrated in FIG. 16A. In the above, as described before, by having the abutted state between the guide arms 121*d* biased with the springs 404, and the abutment portions 125*a* of the rear door 125, the flapper 121 pivots in a direction illustrated by an arrow in FIG. 16B and exposes the conveyance path A. With the above, the user will be able to visually recognize the remaining sheet S immediately after the rear door 125 is opened, and the jam recovery is completed by the user removing the remaining sheet S from the inside of the apparatus and closing the rear door 125.

Note that as illustrated in FIG. 16B, in a state in which the flapper 121 exposes the conveyance path A with the pivot shaft 121*e*, the abutted state between the switch ring 405 (illustrated in FIGS. 4A and 4B) that pivots the flapper 121 from the first state to the second state, and the flapper 121 is cancelled. After the jam recovery has been completed and the flapper 121 is returned to the position illustrated in FIG. 16A, the switch ring 405 and the flapper 121 abut against each other once more, and it will be possible to pivot the flapper 121 between the first state and the second state with the flapper pivoting mechanism 400.

Furthermore, herein, in the present embodiment, when the rear door 125 is closed, the abutment portions 125*a* provided in the rear door 125 and the guide arms 121*d* of the flapper 121 are configured to abut against each other. With the above, with the operation of closing the rear door 125, the flapper 121 can be returned to the position illustrated in FIG. 16A.

As described above, in the present embodiment, a description has been given of a configuration in which the flapper 121 is pivoted by interlocking with the opening operation of the rear door 125; however, not limited to the above, the user may pivot the flapper 121. In such a case, a restriction member that restricts the pivoting of the guide arms 121*d* is provided on the main body of the apparatus side, and the flapper 121 is pivoted by the pivot shaft 121*e* by having the user open the rear door 125 and cancel the restriction of the flapper 121 caused by the restriction member. With the above, similar to the present embodiment, the sheet S remaining in the conveyance path A can be removed.

As described above, in the configuration of the present embodiment, even if the sheet remains in either of the conveyance paths, the remaining sheet can be removed easily.

Fifth Embodiment

In the fourth embodiment, a configuration has been described in which the sheet S discharged or reversed in the first discharge sheet reversing portion 100 is guided by the flapper 105, and the sheet S conveyed towards the first discharge sheet reversing portion 100 and the second discharge sheet reversing portion 510 is guided by the flapper 121. Conversely, as illustrated in FIGS. 17 to 21B, in the fifth embodiment, a second discharge sheet reversing portion 520 (a discharge unit) conveys the sheet S to the conveyance path C or the reverse path D, and the sheet S that is discharged or reversed in the second discharge sheet reversing portion 520 is guided by a flapper 515. Note that in the description hereinafter, configurations and operations that are common with those of the fourth embodiment are denoted with the same reference numerals and description thereof is omitted. The configurations and operations of the second discharge sheet reversing portion 520, a flapper 505, the flapper 521, and the flapper 515 that are different from those of the fourth embodiment will be described mainly.

Figure 17:
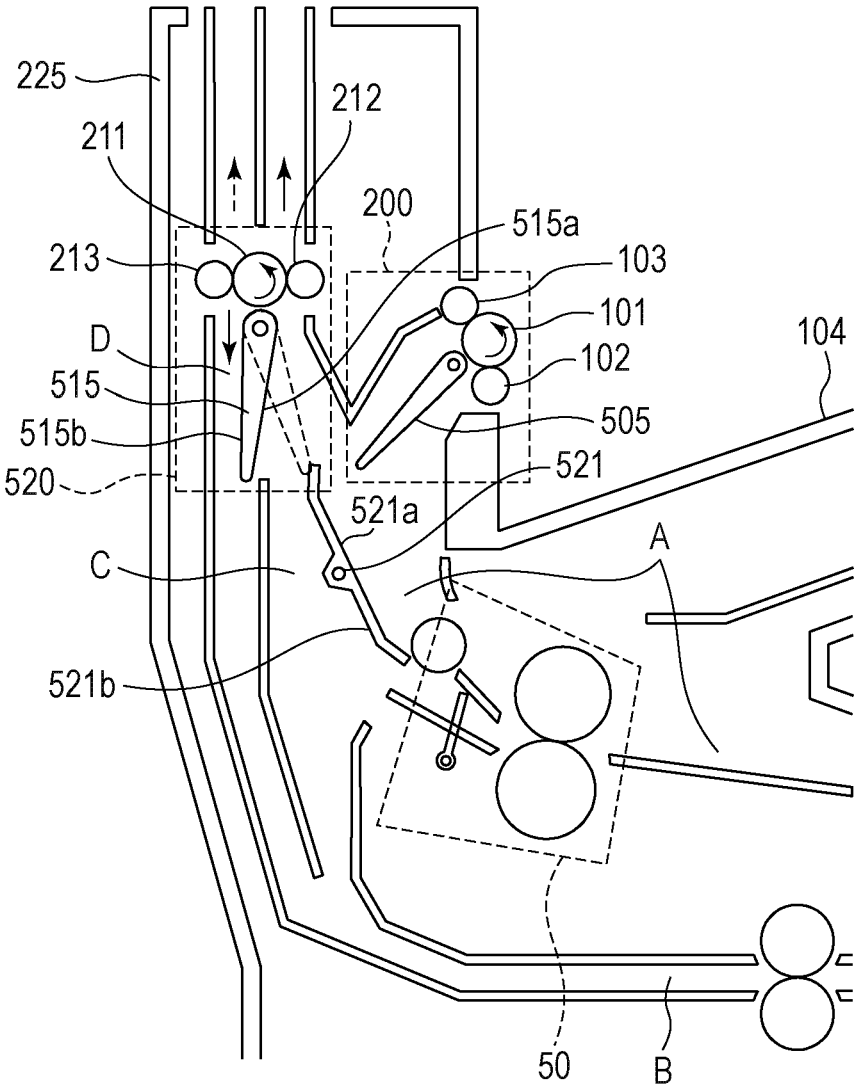
FIG. 17 is a schematic diagram illustrating a configuration of a discharge sheet reversing portion according to a fifth embodiment.

As illustrated in FIG. 17, the second discharge sheet reversing portion 520 includes the driving roller 211 (the fourth rotating member), the sheet discharge roller 212 (the fifth rotating member), the reverse roller 213 (the sixth rotating member), and the flapper 515 (the third guiding member). Receiving driving force from a drive source (not shown), the driving roller 211 is rotated, and following the rotation of the driving roller 211, the sheet discharge roller 212 and the reverse roller 213 are rotated. Furthermore, the sheet discharge roller 212 is in contact with the driving roller 211, and the reverse roller 213 is in contact with the driving roller 211 at a position that is different from that of the sheet discharge roller 212 in a circumferential direction of the driving roller 211. An operation of conveying the sheet S with the flapper 515 is the same as that of the flapper 505.

The flapper 515 at the position illustrated by the solid line in the drawing guides, with a guide surface 515*a*, the sheet S to where the driving roller 211 and the sheet discharge roller 212 abut against each other. Furthermore, the sheet S that has been guided to where the driving roller 211 and the sheet discharge roller 212 abut against each other is conveyed to the conveyance path C by having the driving roller 211 rotate in a direction illustrated by an arrow in the drawing. Furthermore, the flapper 515 at the position illustrated by the broken line in the drawing guides, with a guide surface 515*b*, the sheet S to where the driving roller 211 and the reverse roller 213 abut against each other. Furthermore, the sheet S that has been guided to where the driving roller 211 and the reverse roller 213 abut against each other is conveyed in a broken-line arrow direction and is conveyed to the reverse path D by having the driving roller 211 rotate in a direction opposite to the direction illustrated by the arrow in the drawing.

Subsequently, before the conveyance of the rear edge of the sheet S in the direction of the broken-line arrow in the drawing is completed by the driving roller 211 and the reverse roller 213, the rotation direction of the driving roller 211 is switched to the direction of the arrow in the drawing and the position of the flapper 515 is moved from the position illustrated by a broken line in the drawing to a position illustrated by a solid line in the drawing. With the above, the sheet S is conveyed towards the reverse path B with the driving roller 211 and the reverse roller 213. Note that in the present embodiment, the driving roller 211 and the reverse roller 213 are a reverse unit (a second reverse unit) that reverses the sheet S. The conveyance of the sheet S is performed in the above manner in the second discharge sheet reversing portion 520. Note that in the present embodiment, the sheet S that is conveyed from the conveyance path A towards the second discharge sheet reversing portion 520 is, similar to the first embodiment, guided by a guide surface 521*b* of the flapper 521.

As described above, in the configuration of the present embodiment as well, the sheet S can be conveyed to the first discharge sheet reversing portion with a guide surface 521*a* of the flapper 521, and the sheet S can be conveyed to the second discharge sheet reversing portion with the guide surface 521*b*; accordingly, an effect similar to that of the fourth embodiment can be obtained.

Comb-Teeth Configuration of Flapper

Figure 18A:
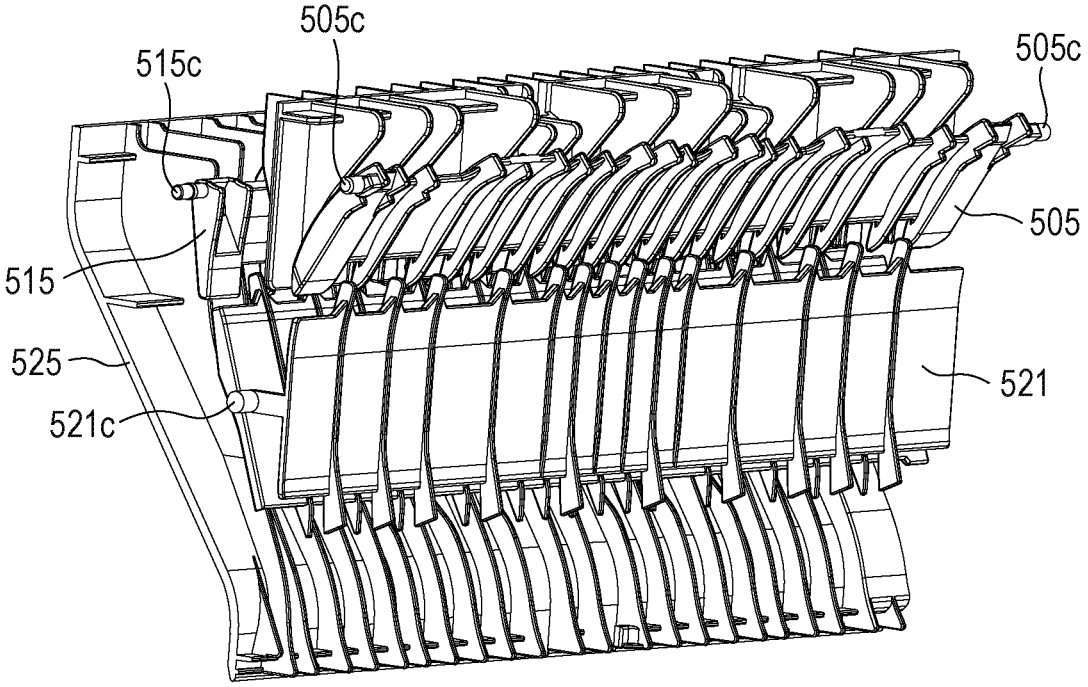
FIGS. 18A and 18B are schematic diagrams illustrating a comb-teeth configuration of the guiding members of the fifth embodiment.
Figure 18B:
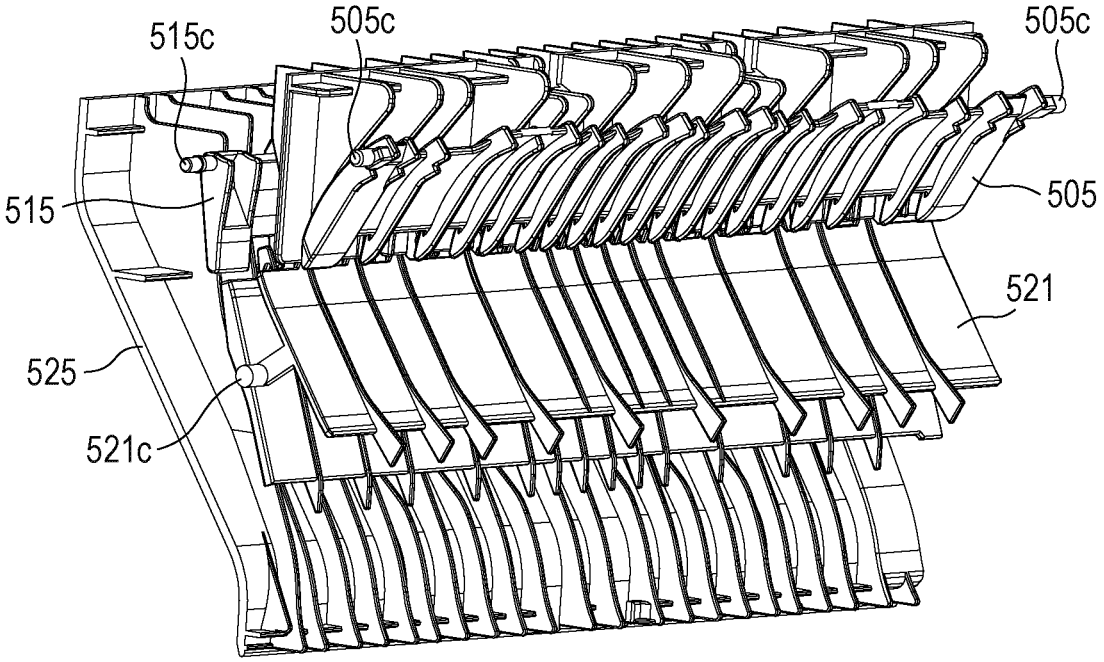
Figure 19A:
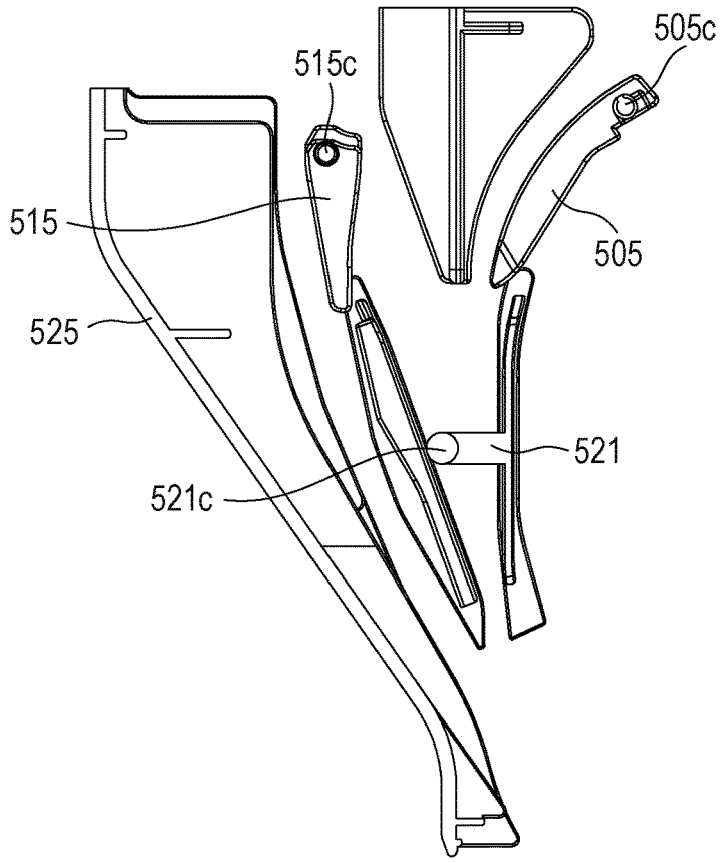
FIGS. 19A and 19B are schematic diagrams illustrating a configuration and an operation of the guiding members according to the fifth embodiment when a sheet is conveyed to the first discharge sheet reversing portion.
Figure 19B:
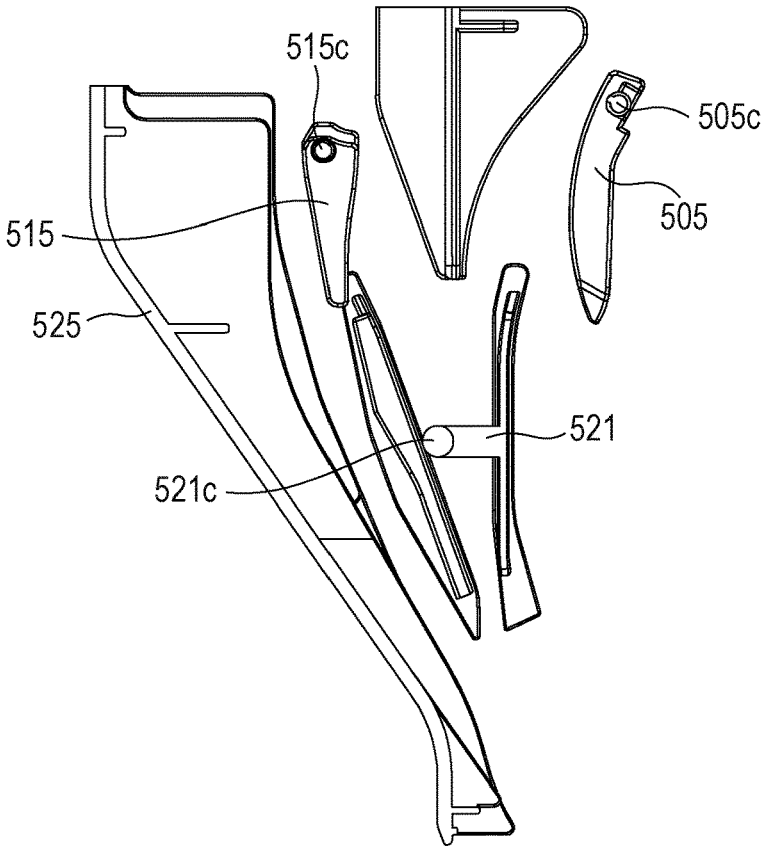
Figure 20A:
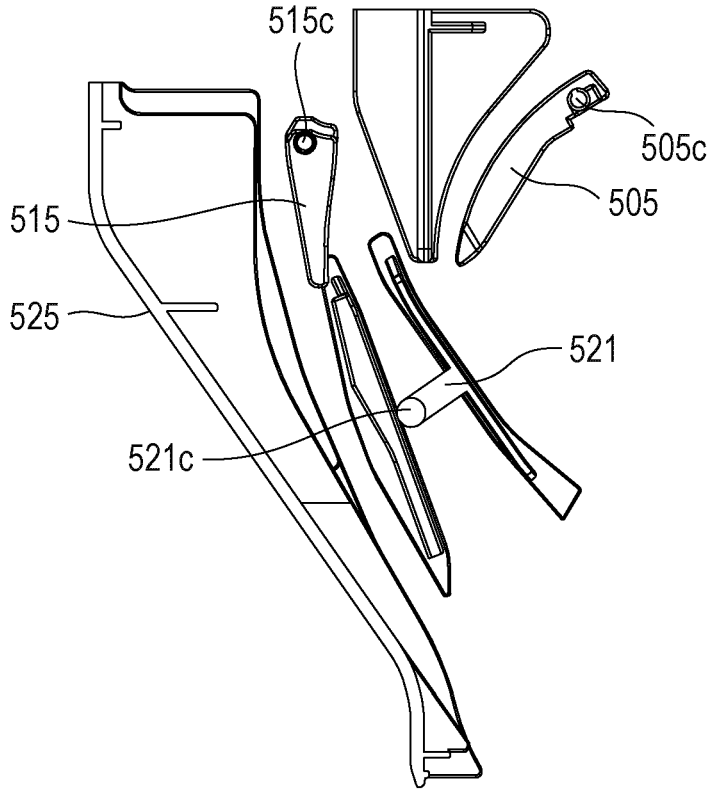
FIGS. 20A and 20B are schematic diagrams illustrating a configuration and an operation of the guiding members according to the fifth embodiment when a sheet is conveyed to the second discharge sheet reversing portion.
Figure 20B:
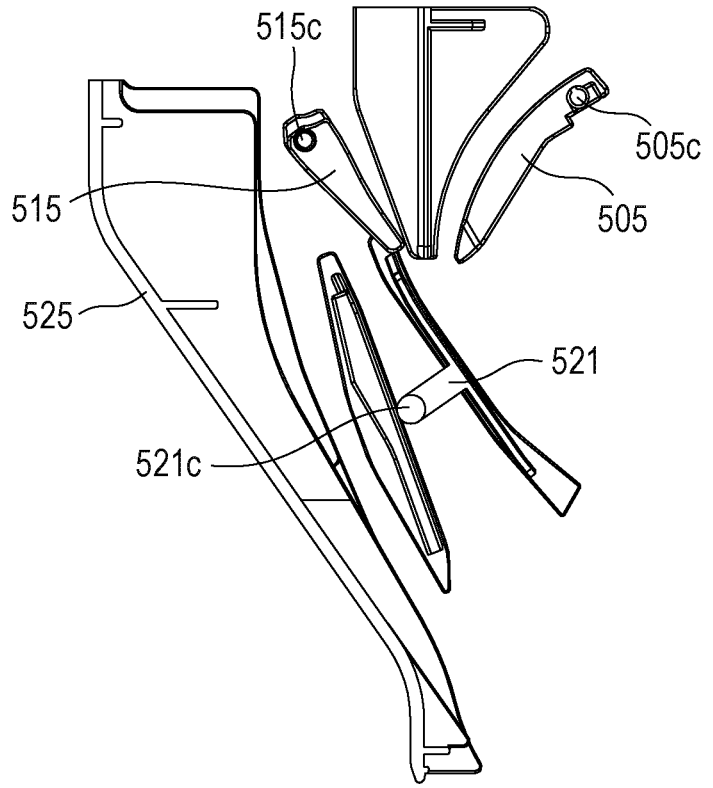

Referring subsequently to FIGS. 18A to 20B, configurations and operations of the flapper 505, the flapper 515, and the flapper 521 according to the present embodiment will be described. FIG. 18A is a schematic diagram illustrating that the flapper 505 and the flapper 521 each have a comb-teeth configuration, and FIG. 18B is a schematic diagram illustrating that the flapper 515 and the flapper 521 each have a comb-teeth configuration. FIGS. 19A and 19B are schematic diagrams illustrating an operation of the flapper 505 when the sheet S is conveyed to the first discharge sheet reversing portion 200, and FIGS. 20A and 20B are schematic diagrams illustrating an operation of the flapper 505 when the sheet S is conveyed to the second discharge sheet reversing portion.

As illustrated in FIG. 18A, in the sheet conveyance direction when the sheet S is conveyed from the conveyance path A to the first discharge sheet reversing portion 200 (illustrated in FIG. 17), the upstream side of the flapper 505 and the downstream side of the flapper 521 have comb-teeth configurations that intersect each other. With the above, as illustrated in FIG. 19A, the comb-teeth portions of the flapper 505 and the flapper 521 can overlap each other. As a result, during the operation of the flapper 505, contact between the flapper 505 and the flapper 521 can be suppressed, and generation of abnormal noise and exhaustion of the components can be suppressed. Furthermore, owing to the comb-teeth configuration, since there will be no vacant spaces in the conveyance path of the sheet S when in a state illustrated in FIG. 19A, error in conveying the sheet S and sheet jamming can be suppressed.

Moreover, as illustrated in FIG. 18B, in the sheet conveyance direction when the sheet S is conveyed from the conveyance path A to the second discharge sheet reversing portion 210 (illustrated in FIG. 17), the upstream side of the flapper 515 and the downstream side of the flapper 521 have comb-teeth configurations that intersect each other. With the above, as illustrated in FIG. 20A, the comb-teeth portions of the flapper 515 and the flapper 521 can overlap each other, and generation of abnormal noise and exhaustion of the components can be suppressed during the operation of the flapper 515; accordingly, the sheet S can be conveyed in a stable manner.

Jam Recovery Method

Figure 21B:
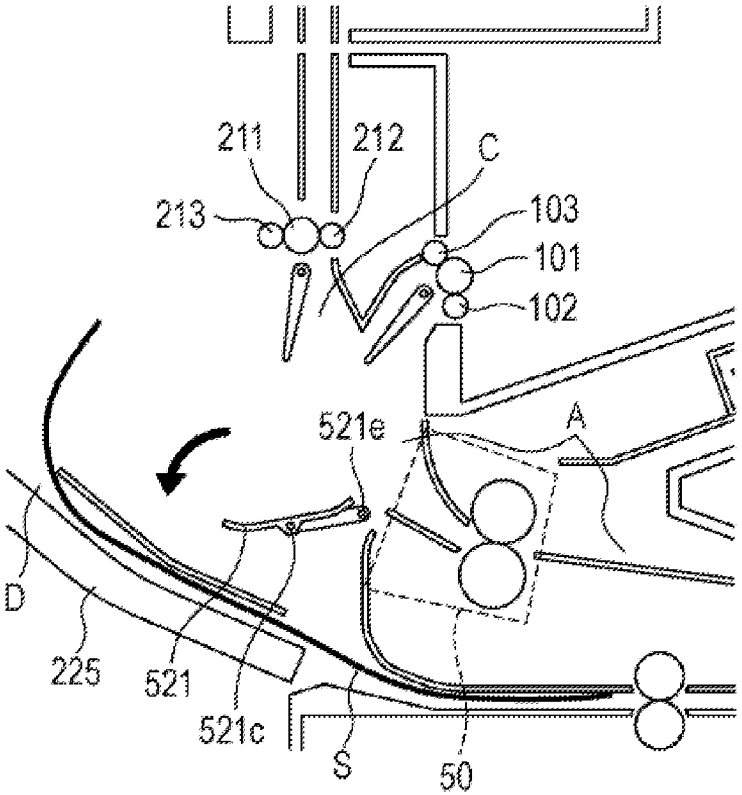
FIGS. 21A and 21B are schematic diagrams illustrating an operation carried out when performing a jam recovery in the fifth embodiment.
Figure 21A:
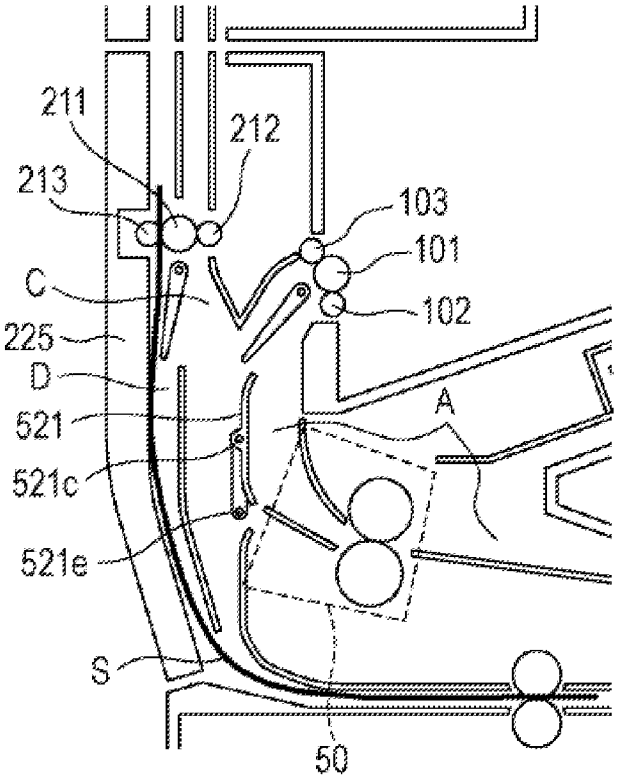

Referring next to FIGS. 21A and 21B, a jam recovery method in the present embodiment in a case in which sheet jamming has occurred and the sheet S remains in a conveyance path D will be described. FIG. 21A is a schematic diagram illustrating a state in which the sheet S remains in the conveyance path D in the configuration of the present embodiment, and FIG. 21B is a schematic diagram illustrating a state in which the rear door 225 is opened to remove the sheet S remaining in the conveyance path D.

As illustrated in FIGS. 21A and 21B, the rear door 225 is an opening and closing member that is capable of exposing the conveyance path C by being opened, and in the present embodiment as well, similar to the first embodiment, the flapper 521 includes two pivot shafts, namely, a pivot shaft 221*c* and a pivot shaft 221*e*. Note that the jam recovery method in the present embodiment in a case in which the sheet S remains in a conveyance path C or the conveyance path A is similar to that of the first embodiment and description thereof will be omitted.

As illustrated in FIG. 21A, a case in which the sheet S remains in the conveyance path D while the sheet S is pinched between the driving roller 211 and the reverse roller 213 will be described. When the rear door 225 is opened in the above state, the sheet S remaining in the conveyance path D moves together with the rear door 225 that pivots in a direction of an arrow in the drawing and is pulled out from a holding portion formed between the driving roller 211 and the reverse roller 213, reaching a state illustrated in FIG. 21B. With the above, the user can visually recognize the remaining sheet S immediately after opening the rear door 225. The jam recovery is completed when the user closes the rear door 225 after removing the sheet S from inside the apparatus.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2017-119843 filed Jun. 19, 2017, No.

2017-119844 filed Jun. 19, 2017, and No. 2017-127998 filed Jun. 29, 2017, which are hereby incorporated by reference herein in their entirety.

What is claimed is:

1. A sheet conveying apparatus comprising:

a storage portion configured to store a sheet;

a first conveyance path along which the sheet stored in the storage portion is to be conveyed;

a first stack portion on which the sheet that has passed through the first conveyance path is to be stacked;

a first conveyance unit configured to convey the sheet in a first direction from the first conveyance path to the first stack portion and capable of conveying the sheet in a second direction that is an opposite of the first direction;

a first reverse path along which the sheet conveyed in the second direction by the first conveyance unit is sent for arrival at the first conveyance path again;

a second stack portion on which a sheet is to be stacked, wherein the second stack portion is provided at a position different from that of the first stack portion;

a second conveyance path branching off from the first conveyance path at a branching point upstream of the first conveyance unit in the first direction so as to convey a sheet via the first conveyance path to the second stack portion;

a second conveyance unit configured to convey the sheet in the first direction from the second conveyance path to the second stack portion and capable of conveying a sheet in the second direction; and a second reverse path along which the sheet conveyed in the second direction by the second conveyance unit is sent for arrival at the first conveyance path again, wherein the second conveyance path and the first reverse path intersect with each other at an intersection point downstream of the branching point in the first direction, and wherein the second conveyance unit is provided downstream of the intersection point in the first direction.

2. The sheet conveying apparatus according to claim 1, wherein the first conveyance unit includes, a first rotating member configured to rotate by receiving driving force, a second rotating member configured to be rotated by following the first rotating member, and a third rotating member in contact with the first rotating member at a position different from a contact point of the second rotating member in a circumferential direction of the first rotating member, wherein rotating the first rotating member and the second rotating member discharges a sheet to the first stack portion and rotating the first rotating member and the third rotating member conveys a sheet to the first reverse path.

3. The sheet conveying apparatus according to claim 2, further comprising:

a first guiding member provided at the branching point, wherein, in a first state, the first guiding member guides a sheet towards the first conveyance unit using a first guide surface and, in a second state, which is a state pivoted from the first state, the first guiding member guides a sheet to the second conveyance unit with a second guide surface that is a surface opposite to the first guide surface; and a second guiding member configured to guide a sheet to a position where the first rotating member and the second rotating member abut against each other or to a position where the first rotating member and the third rotating member abut against each other, wherein the second guiding member includes, a third guide surface configured to guide a sheet to a position where the first rotating member and the second rotating member abut against each other, and a fourth guide surface configured to guide a sheet to a position where the first rotating member and the third rotating member abut against each other.

4. The sheet conveying apparatus according to claim 3, wherein a downstream side of the first guiding member in a conveyance direction, which is a direction in which a sheet is conveyed from the storage portion to the first conveyance unit, and an upstream side of the second guiding member in the conveyance direction overlap each other without coming in contact with each other in a direction intersecting the conveyance direction.

5. The sheet conveying apparatus according to claim 3, wherein the second conveyance unit includes, a fourth rotating member configured to rotate by receiving driving force, a fifth rotating member configured to be rotated by following the fourth rotating member, and a sixth rotating member in contact with the fourth rotating member at a position different from that of the fifth rotating member in a circumferential direction of the fourth rotating member, wherein rotating the fourth rotating member and the fifth rotating member conveys a sheet to the second stack portion and rotating the fourth rotating member and the sixth rotating member conveys and reverses a sheet towards the second reverse path.

6. The sheet conveying apparatus according to claim 1, wherein the second conveyance unit includes, a fourth rotating member configured to rotate by receiving driving force, a fifth rotating member configured to be rotated by following the fourth rotating member, and a sixth rotating member in contact with the fourth rotating member at a position different from that of the fifth rotating member in a circumferential direction of the fourth rotating member, wherein rotating the fourth rotating member and the fifth rotating member conveys a sheet to the second stack portion and rotating the fourth rotating member and the sixth rotating member conveys and reverses a sheet towards the second reverse path.

7. The sheet conveying apparatus according to claim 6, further comprising:

a first guiding member provided at a branching point between the first conveyance path and the second conveyance path, wherein, in a first state, the first guiding member guides a sheet towards the first conveyance unit with a first guide surface and, in a second state, which is a state pivoted from the first state, the first guiding member guides a sheet to the second conveyance unit with a second guide surface that is a surface opposite to the first guide surface; and a third guiding member configured to guide a sheet to a position where the fourth rotating member and the fifth rotating member abut against each other or to a position where the fourth rotating member and the sixth rotating member abut against each other, wherein the third guiding member includes, a fifth guide surface configured to guide a sheet to a position where the fourth rotating member and the fifth rotating member abut against each other, and a sixth guide surface configured to guide a sheet to a position where the fourth rotating member and the sixth rotating member abut against each other.

8. The sheet conveying apparatus according to claim 7, wherein a downstream side of the first guiding member in a conveyance direction, which is a direction in which a sheet is conveyed from the storage portion to the second conveyance unit, and an upstream side of the third guiding member in the conveyance direction overlap each other without coming in contact with each other in a direction intersecting the conveyance direction.

9. The sheet conveying apparatus according to claim 1, wherein, in a case where a first sheet and a second sheet succeeding the first sheet are continuously conveyed, and in which the second sheet is conveyed and discharged to the second stack portion, the second conveyance unit conveys the second sheet towards the second stack portion while conveying and reversing the first sheet towards the first reverse path.

10. The sheet conveying apparatus according to claim 1, wherein, in a case where a first sheet and a second sheet succeeding the first sheet are continuously conveyed, and in which the second sheet is conveyed and discharged to the first stack portion, the first conveyance unit conveys the second sheet towards the first stack portion while conveying and reversing the first sheet towards the second reverse path.

11. The sheet conveying apparatus according to claim 1, further comprising a first guiding member provided at the branching point, wherein, in a first state, the first guiding member guides a sheet towards the first conveyance unit with a first guide surface and, in a second state, which is a state pivoted from the first state, the first guiding member guides a sheet to the second conveyance unit with a second guide surface that is a surface opposite to the first guide surface, and wherein, in the first state, the first guiding member guides a sheet in a direction extending from the first conveyance unit towards the first reverse path with the second guide surface.

12. The sheet conveying apparatus according to claim 11, wherein the first guiding member includes a pivot shaft configured to pivot the first guiding member from the first state to the second state, and wherein both ends of the first guiding member in a direction intersecting an axial direction of the pivot shaft are free ends.

13. The sheet conveying apparatus according to claim 12, wherein, in the first guiding member, the first guide surface is formed on an upstream side and on a downstream side of the pivot shaft in a conveyance direction of a sheet in the first conveyance path, and the second guide surface is formed on the upstream side and on the downstream side of the pivot shaft in the conveyance direction.

14. An image forming apparatus comprising:

an image forming portion configured to form an image on a sheet; and the sheet conveying apparatus according to claim 1, wherein, in a case where an image has been formed in the image forming portion, the sheet on which an image has been formed is conveyed in the first conveyance path.

* * * * *